US010096909B2

(12) United States Patent
Schwartzman et al.

(10) Patent No.: US 10,096,909 B2
(45) Date of Patent: Oct. 9, 2018

(54) MULTI-BAND MONOPOLE PLANAR ANTENNAS CONFIGURED TO FACILITATE IMPROVED RADIO FREQUENCY (RF) ISOLATION IN MULTIPLE-INPUT MULTIPLE-OUTPUT (MIMO) ANTENNA ARRANGEMENT

(71) Applicant: Corning Optical Communications Wireless Ltd, Airport City (IL)

(72) Inventors: Ronen Schwartzman, Rehovot (IL); Yuval Tzur, Kochav Yair (IL)

(73) Assignee: Corning Optical Communications Wireless Ltd., Airport (IL)

( * ) Notice: Subject to any disclaimer, the term of this patent is extended or adjusted under 35 U.S.C. 154(b) by 12 days.

(21) Appl. No.: 15/473,977

(22) Filed: Mar. 30, 2017

(65) Prior Publication Data

US 2017/0207548 A1 Jul. 20, 2017

Related U.S. Application Data

(63) Continuation of application No. PCT/IL2015/051061, filed on Oct. 29, 2015.
(Continued)

(51) Int. Cl.
*H01Q 21/24* (2006.01)
*H01Q 9/36* (2006.01)
(Continued)

(52) U.S. Cl.
CPC ..... *H01Q 21/24* (2013.01); *H01Q 1/38* (2013.01); *H01Q 1/523* (2013.01); *H01Q 5/30* (2015.01); *H01Q 9/36* (2013.01); *H01Q 9/40* (2013.01)

(58) Field of Classification Search
None
See application file for complete search history.

(56) References Cited

U.S. PATENT DOCUMENTS 4,365,865 A 12/1982 Stiles
4,867,527 A 9/1989 Dotti et al.
(Continued)

FOREIGN PATENT DOCUMENTS

AU 645192 B2 1/1994
AU 731180 B2 3/2001
(Continued)

OTHER PUBLICATIONS

Final Office Action for U.S. Appl. No. 14/711,306 dated Jul. 9, 2015, 16 pages.
(Continued)

*Primary Examiner* — Howard Williams
(74) *Attorney, Agent, or Firm* — C. Keith Montgomery

(57) ABSTRACT

Embodiments disclosed include multi-band monopole planar antennas configured to facilitate radio frequency (RF) isolation in multiple-input multiple-output (MIMO) antenna arrangement. In one aspect, a multi-band monopole planar antenna is provided and configured to generate a slant 45° radiation polarization in the lower frequency band. As a result, sufficient RF isolation may be achieved in the lower frequency band when a plurality of dual-band monopole planar antennas is placed in the MIMO arrangement. In another aspect, the multi-band monopole planar antenna is configured not to support certain unused RF bands, thus facilitating height reduction in the multi-band monopole planar antenna. By configuring the dual-band monopole planar antenna to generate the slant-45 radiation polarization in the lower frequency band, a plurality of the multi-band monopole planar antennas may be placed in close proximity
(Continued)

to each other to support MIMO operation without compromising RF performance.

20 Claims, 8 Drawing Sheets

Related U.S. Application Data

(60) Provisional application No. 62/074,293, filed on Nov. 3, 2014.

(51) Int. Cl.

| | |
|---|---|
| ***H01Q 1/38*** | (2006.01) |
| ***H01Q 5/30*** | (2015.01) |
| ***H01Q 1/52*** | (2006.01) |
| ***H01Q 9/40*** | (2006.01) |

(56) References Cited

U.S. PATENT DOCUMENTS

| | | | |
|---|---|---|---|
| 4,889,977 | A | 12/1989 | Haydon |
| 4,896,939 | A | 1/1990 | O'Brien |
| 4,916,460 | A | 4/1990 | Powell |
| 4,972,505 | A | 11/1990 | Isberg |
| 5,039,195 | A | 8/1991 | Jenkins et al. |
| 5,042,086 | A | 8/1991 | Cole et al. |
| 5,125,060 | A | 6/1992 | Edmundson |
| 5,189,718 | A | 2/1993 | Barrett et al. |
| 5,189,719 | A | 2/1993 | Coleman et al. |
| 5,206,655 | A | 4/1993 | Caille et al. |
| 5,210,812 | A | 5/1993 | Nilsson et al. |
| 5,260,957 | A | 11/1993 | Hakimi et al. |
| 5,263,108 | A | 11/1993 | Kurokawa et al. |
| 5,267,122 | A | 11/1993 | Glover et al. |
| 5,268,971 | A | 12/1993 | Nilsson et al. |
| 5,280,472 | A | 1/1994 | Gilhousen et al. |
| 5,295,154 | A | 3/1994 | Meier et al. |
| 5,299,947 | A | 4/1994 | Barnard |
| 5,301,056 | A | 4/1994 | O'Neill |
| 5,339,058 | A | 8/1994 | Lique |
| 5,339,184 | A | 8/1994 | Tang |
| 5,377,035 | A | 12/1994 | Wang et al. |
| 5,379,455 | A | 1/1995 | Koschek |
| 5,400,391 | A | 3/1995 | Emura et al. |
| 5,404,570 | A | 4/1995 | Charas et al. |
| 5,424,864 | A | 6/1995 | Emura |
| 5,428,636 | A | 6/1995 | Meier |
| 5,444,564 | A | 8/1995 | Newberg |
| 5,457,557 | A | 10/1995 | Zarem et al. |
| 5,459,727 | A | 10/1995 | Vannucci |
| 5,469,523 | A | 11/1995 | Blew et al. |
| 5,499,241 | A | 3/1996 | Thompson et al. |
| 5,504,746 | A | 4/1996 | Meier |
| 5,519,691 | A | 5/1996 | Darcie et al. |
| 5,543,000 | A | 8/1996 | Lique |
| 5,544,161 | A | 8/1996 | Bigham et al. |
| 5,546,443 | A | 8/1996 | Raith |
| 5,553,064 | A | 9/1996 | Paff et al. |
| 5,557,698 | A | 9/1996 | Gareis et al. |
| 5,574,815 | A | 11/1996 | Kneeland |
| 5,598,288 | A | 1/1997 | Collar |
| 5,603,080 | A | 2/1997 | Kallander et al. |
| 5,615,034 | A | 3/1997 | Hori |
| 5,621,786 | A | 4/1997 | Fischer et al. |
| 5,627,879 | A | 5/1997 | Russell et al. |
| 5,640,678 | A | 6/1997 | Ishikawa et al. |
| 5,642,405 | A | 6/1997 | Fischer et al. |
| 5,644,622 | A | 7/1997 | Russell et al. |
| 5,648,961 | A | 7/1997 | Ebihara |
| 5,651,081 | A | 7/1997 | Blew et al. |
| 5,657,374 | A | 8/1997 | Russell et al. |
| 5,668,562 | A | 9/1997 | Cutrer et al. |
| 5,677,974 | A | 10/1997 | Elms et al. |
| 5,682,256 | A | 10/1997 | Motley et al. |
| 5,684,799 | A | 11/1997 | Bigham et al. |
| 5,689,355 | A | 11/1997 | Okubo et al. |
| 5,703,602 | A | 12/1997 | Casebolt |
| 5,726,984 | A | 3/1998 | Kubler et al. |
| 5,774,789 | A | 6/1998 | van der Kaay et al. |
| 5,790,536 | A | 8/1998 | Mahany et al. |
| 5,790,606 | A | 8/1998 | Dent |
| 5,802,173 | A | 9/1998 | Hamilton-Piercy et al. |
| 5,802,473 | A | 9/1998 | Rutledge et al. |
| 5,805,983 | A | 9/1998 | Naidu et al. |
| 5,809,422 | A | 9/1998 | Raleigh et al. |
| 5,812,296 | A | 9/1998 | Tarusawa et al. |
| 5,818,619 | A | 10/1998 | Medved et al. |
| 5,821,510 | A | 10/1998 | Cohen et al. |
| 5,825,651 | A | 10/1998 | Gupta et al. |
| 5,825,829 | A | 10/1998 | Borazjani et al. |
| 5,832,364 | A | 11/1998 | Gustafson |
| 5,838,474 | A | 11/1998 | Stilling |
| 5,852,651 | A | 12/1998 | Fischer et al. |
| 5,854,986 | A | 12/1998 | Dorren et al. |
| 5,867,485 | A | 2/1999 | Chambers et al. |
| 5,880,863 | A | 3/1999 | Rideout et al. |
| 5,881,200 | A | 3/1999 | Burt |
| 5,883,882 | A | 3/1999 | Schwartz |
| 5,890,055 | A | 3/1999 | Chu et al. |
| 5,896,568 | A | 4/1999 | Tseng et al. |
| 5,903,834 | A | 5/1999 | Wallstedt et al. |
| 5,910,776 | A | 6/1999 | Black |
| 5,913,003 | A | 6/1999 | Arroyo et al. |
| 5,917,636 | A | 6/1999 | Wake et al. |
| 5,930,682 | A | 7/1999 | Schwartz et al. |
| 5,936,754 | A | 8/1999 | Ariyavisitakul et al. |
| 5,943,372 | A | 8/1999 | Gans et al. |
| 5,946,622 | A | 8/1999 | Bojeryd |
| 5,949,564 | A | 9/1999 | Wake |
| 5,959,531 | A | 9/1999 | Gallagher, III et al. |
| 5,960,344 | A | 9/1999 | Mahany |
| 5,969,837 | A | 10/1999 | Farber et al. |
| 5,982,413 | A | 11/1999 | Irie et al. |
| 5,983,070 | A | 11/1999 | Georges et al. |
| 5,987,303 | A | 11/1999 | Dutta et al. |
| 6,005,884 | A | 12/1999 | Cook et al. |
| 6,006,105 | A | 12/1999 | Rostoker et al. |
| 6,014,546 | A | 1/2000 | Georges et al. |
| 6,016,426 | A | 1/2000 | Bodell |
| 6,023,625 | A | 2/2000 | Myers, Jr. |
| 6,046,992 | A | 4/2000 | Meier et al. |
| 6,067,053 | A | 5/2000 | Runyon et al. |
| 6,078,622 | A | 6/2000 | Boytim et al. |
| 6,088,381 | A | 7/2000 | Myers, Jr. |
| 6,112,086 | A | 8/2000 | Wala |
| 6,124,957 | A | 9/2000 | Goel et al. |
| 6,127,917 | A | 10/2000 | Tuttle |
| 6,128,470 | A | 10/2000 | Naidu et al. |
| 6,148,041 | A | 11/2000 | Dent |
| 6,150,921 | A | 11/2000 | Werb et al. |
| 6,157,810 | A | 12/2000 | Georges et al. |
| 6,219,553 | B1 | 4/2001 | Panasik |
| 6,222,503 | B1 | 4/2001 | Gietema et al. |
| 6,223,021 | B1 | 4/2001 | Silvia et al. |
| 6,232,870 | B1 | 5/2001 | Garber et al. |
| 6,236,789 | B1 | 5/2001 | Fitz |
| 6,240,274 | B1 | 5/2001 | Izadpanah |
| 6,268,946 | B1 | 7/2001 | Larkin et al. |
| 6,292,673 | B1 | 9/2001 | Maeda et al. |
| 6,301,240 | B1 | 10/2001 | Slabinski et al. |
| 6,314,163 | B1 | 11/2001 | Acampora |
| 6,317,599 | B1 | 11/2001 | Rappaport et al. |
| 6,323,980 | B1 | 11/2001 | Bloom |
| 6,324,391 | B1 | 11/2001 | Bodell |
| 6,330,244 | B1 | 12/2001 | Swartz et al. |
| 6,334,219 | B1 | 12/2001 | Hill et al. |
| 6,337,754 | B1 | 1/2002 | Imajo |
| 6,353,406 | B1 | 3/2002 | Lanzl et al. |
| 6,353,600 | B1 | 3/2002 | Schwartz et al. |
| 6,356,374 | B1 | 3/2002 | Farhan |
| 6,359,714 | B1 | 3/2002 | Imajo |
| 6,373,611 | B1 | 4/2002 | Farhan et al. |
| 6,374,078 | B1 | 4/2002 | Williams et al. |

(56) References Cited

U.S. PATENT DOCUMENTS

| | | | |
|---|---|---|---|
| 6,374,124 | B1 | 4/2002 | Slabinski |
| 6,374,311 | B1 | 4/2002 | Mahany et al. |
| 6,389,010 | B1 | 5/2002 | Kubler et al. |
| 6,392,770 | B1 | 5/2002 | Sasai et al. |
| 6,405,018 | B1 | 6/2002 | Reudink et al. |
| 6,405,058 | B2 | 6/2002 | Bobier |
| 6,405,308 | B1 | 6/2002 | Gupta et al. |
| 6,438,301 | B1 | 8/2002 | Johnson et al. |
| 6,438,371 | B1 | 8/2002 | Fujise et al. |
| 6,452,915 | B1 | 9/2002 | Jorgensen |
| 6,477,154 | B1 | 11/2002 | Cheong et al. |
| 6,480,702 | B1 | 11/2002 | Sabat, Jr. |
| 6,486,907 | B1 | 11/2002 | Farber et al. |
| 6,496,290 | B1 | 12/2002 | Lee |
| 6,501,768 | B2 | 12/2002 | Marin et al. |
| 6,501,942 | B1 | 12/2002 | Weissman et al. |
| 6,501,965 | B1 | 12/2002 | Lucidarme |
| 6,504,636 | B1 | 1/2003 | Seto et al. |
| 6,512,478 | B1 | 1/2003 | Chien |
| 6,519,395 | B1 | 2/2003 | Bevan et al. |
| 6,523,177 | B1 | 2/2003 | Brown |
| 6,525,855 | B1 | 2/2003 | Westbrook et al. |
| 6,526,264 | B2 | 2/2003 | Sugar et al. |
| 6,549,772 | B1 | 4/2003 | Chavez et al. |
| 6,556,551 | B1 | 4/2003 | Schwartz |
| 6,560,441 | B1 | 5/2003 | Sabat, Jr. et al. |
| 6,577,794 | B1 | 6/2003 | Currie et al. |
| 6,577,801 | B2 | 6/2003 | Broderick et al. |
| 6,580,402 | B2 | 6/2003 | Navarro et al. |
| 6,580,905 | B1 | 6/2003 | Naidu et al. |
| 6,580,918 | B1 | 6/2003 | Leickel et al. |
| 6,583,763 | B2 | 6/2003 | Judd |
| 6,594,496 | B2 | 7/2003 | Schwartz |
| 6,597,325 | B2 | 7/2003 | Judd et al. |
| 6,606,430 | B2 | 8/2003 | Bartur et al. |
| 6,615,074 | B2 | 9/2003 | Mickle et al. |
| 6,634,811 | B1 | 10/2003 | Gertel et al. |
| 6,636,747 | B2 | 10/2003 | Harada et al. |
| 6,640,103 | B1 | 10/2003 | Inman et al. |
| 6,643,437 | B1 | 11/2003 | Park |
| 6,652,158 | B2 | 11/2003 | Bartur et al. |
| 6,654,616 | B1 | 11/2003 | Pope, Jr. et al. |
| 6,657,535 | B1 | 12/2003 | Magbie et al. |
| 6,658,269 | B1 | 12/2003 | Golemon et al. |
| 6,670,930 | B2 | 12/2003 | Navarro |
| 6,675,294 | B1 | 1/2004 | Gupta et al. |
| 6,687,437 | B1 | 2/2004 | Starnes et al. |
| 6,690,328 | B2 | 2/2004 | Judd |
| 6,697,603 | B1 | 2/2004 | Lovinggood et al. |
| 6,704,298 | B1 | 3/2004 | Matsumiya et al. |
| 6,704,545 | B1 | 3/2004 | Wala |
| 6,704,579 | B2 | 3/2004 | Woodhead et al. |
| 6,710,366 | B1 | 3/2004 | Lee et al. |
| 6,731,880 | B2 | 5/2004 | Westbrook et al. |
| 6,758,913 | B1 | 7/2004 | Tunney et al. |
| 6,763,226 | B1 | 7/2004 | McZeal, Jr. |
| 6,771,862 | B2 | 8/2004 | Karnik et al. |
| 6,771,933 | B1 | 8/2004 | Eng et al. |
| 6,784,802 | B1 | 8/2004 | Stanescu |
| 6,785,558 | B1 | 8/2004 | Stratford et al. |
| 6,788,666 | B1 | 9/2004 | Linebarger et al. |
| 6,801,767 | B1 | 10/2004 | Schwartz et al. |
| 6,807,374 | B1 | 10/2004 | Imajo et al. |
| 6,812,824 | B1 | 11/2004 | Goldinger et al. |
| 6,812,905 | B2 | 11/2004 | Thomas et al. |
| 6,826,164 | B2 | 11/2004 | Mani et al. |
| 6,826,165 | B1 | 11/2004 | Meier et al. |
| 6,826,337 | B2 | 11/2004 | Linnell |
| 6,831,901 | B2 | 12/2004 | Millar |
| 6,842,433 | B2 | 1/2005 | West et al. |
| 6,842,459 | B1 | 1/2005 | Binder |
| 6,847,856 | B1 | 1/2005 | Bohannon |
| 6,850,510 | B2 | 2/2005 | Kubler et al. |
| 6,865,390 | B2 | 3/2005 | Goss et al. |
| 6,873,823 | B2 | 3/2005 | Hasarchi et al. |
| 6,876,056 | B2 | 4/2005 | Tilmans et al. |
| 6,876,852 | B1 | 4/2005 | Li et al. |
| 6,879,290 | B1 | 4/2005 | Toutain et al. |
| 6,882,833 | B2 | 4/2005 | Nguyen |
| 6,883,710 | B2 | 4/2005 | Chung |
| 6,885,846 | B1 | 4/2005 | Panasik et al. |
| 6,889,060 | B2 | 5/2005 | Fernando et al. |
| 6,895,185 | B1 | 5/2005 | Chung et al. |
| 6,895,253 | B1 | 5/2005 | Carloni et al. |
| 6,909,399 | B1 | 6/2005 | Zegelin et al. |
| 6,915,058 | B2 | 7/2005 | Pons |
| 6,919,858 | B2 | 7/2005 | Rofougaran |
| 6,920,330 | B2 | 7/2005 | Caronni et al. |
| 6,924,997 | B2 | 8/2005 | Chen et al. |
| 6,930,987 | B1 | 8/2005 | Fukuda et al. |
| 6,931,183 | B2 | 8/2005 | Panak et al. |
| 6,933,849 | B2 | 8/2005 | Sawyer |
| 6,940,916 | B1 | 9/2005 | Warner et al. |
| 6,961,312 | B2 | 11/2005 | Kubler et al. |
| 6,963,289 | B2 | 11/2005 | Aljadeff et al. |
| 6,963,552 | B2 | 11/2005 | Sabat, Jr. et al. |
| 6,965,718 | B2 | 11/2005 | Koertel |
| 6,968,107 | B2 | 11/2005 | Belardi et al. |
| 6,970,652 | B2 | 11/2005 | Zhang et al. |
| 6,973,243 | B2 | 12/2005 | Koyasu et al. |
| 6,974,262 | B1 | 12/2005 | Rickenbach |
| 7,006,465 | B2 | 2/2006 | Toshimitsu et al. |
| 7,013,087 | B2 | 3/2006 | Suzuki et al. |
| 7,015,826 | B1 | 3/2006 | Chan et al. |
| 7,016,308 | B1 | 3/2006 | Gallagher |
| 7,020,451 | B2 | 3/2006 | Sugar et al. |
| 7,020,473 | B2 | 3/2006 | Splett |
| 7,024,166 | B2 | 4/2006 | Wallace et al. |
| 7,035,512 | B2 | 4/2006 | Van Bijsterveld |
| 7,035,671 | B2 | 4/2006 | Solum |
| 7,039,399 | B2 | 5/2006 | Fischer |
| 7,047,028 | B2 | 5/2006 | Cagenius |
| 7,050,017 | B2 | 5/2006 | King et al. |
| 7,053,838 | B2 | 5/2006 | Judd |
| 7,054,513 | B2 | 5/2006 | Herz et al. |
| 7,072,586 | B2 | 7/2006 | Aburakawa et al. |
| 7,082,320 | B2 | 7/2006 | Kattukaran et al. |
| 7,084,769 | B2 | 8/2006 | Bauer et al. |
| 7,092,710 | B1 | 8/2006 | Stoter et al. |
| 7,093,985 | B2 | 8/2006 | Lord et al. |
| 7,103,312 | B2 | 9/2006 | Judd et al. |
| 7,103,377 | B2 | 9/2006 | Bauman et al. |
| 7,106,931 | B2 | 9/2006 | Sutehall et al. |
| 7,110,381 | B1 | 9/2006 | O'Sullivan et al. |
| 7,114,859 | B1 | 10/2006 | Tuohimaa et al. |
| 7,127,175 | B2 | 10/2006 | Mani et al. |
| 7,127,176 | B2 | 10/2006 | Sasaki |
| 7,133,697 | B2 | 11/2006 | Judd et al. |
| 7,142,503 | B1 | 11/2006 | Grant et al. |
| 7,142,535 | B2 | 11/2006 | Kubler et al. |
| 7,160,032 | B2 | 1/2007 | Nagashima et al. |
| 7,181,206 | B2 | 2/2007 | Pedersen |
| 7,199,443 | B2 | 4/2007 | Elsharawy |
| 7,200,305 | B2 | 4/2007 | Dion et al. |
| 7,200,391 | B2 | 4/2007 | Chung et al. |
| 7,228,072 | B2 | 6/2007 | Mickelsson et al. |
| 7,245,603 | B1 | 7/2007 | Lucidarme et al. |
| 7,257,328 | B2 | 8/2007 | Levinson et al. |
| 7,263,293 | B2 | 8/2007 | Ommodt et al. |
| 7,269,311 | B2 | 9/2007 | Kim et al. |
| 7,277,679 | B1 | 10/2007 | Barratt et al. |
| 7,286,507 | B1 | 10/2007 | Oh et al. |
| 7,286,843 | B2 | 10/2007 | Scheck |
| 7,286,854 | B2 | 10/2007 | Ferrato et al. |
| 7,295,119 | B2 | 11/2007 | Rappaport et al. |
| 7,310,430 | B1 | 12/2007 | Mallya et al. |
| 7,313,415 | B2 | 12/2007 | Wake et al. |
| 7,315,735 | B2 | 1/2008 | Graham |
| 7,324,730 | B2 | 1/2008 | Varkey et al. |
| 7,343,164 | B2 | 3/2008 | Kallstenius |
| 7,349,633 | B2 | 3/2008 | Lee et al. |
| 7,359,408 | B2 | 4/2008 | Kim |
| 7,359,674 | B2 | 4/2008 | Markki et al. |
| 7,366,150 | B2 | 4/2008 | Lee et al. |

(56) References Cited

U.S. PATENT DOCUMENTS

| | | | |
|---|---|---|---|
| 7,366,151 | B2 | 4/2008 | Kubler et al. |
| 7,369,526 | B2 | 5/2008 | Lechleider et al. |
| 7,379,669 | B2 | 5/2008 | Kim |
| 7,392,029 | B2 | 6/2008 | Pronkine |
| 7,394,883 | B2 | 7/2008 | Funakubo et al. |
| 7,403,156 | B2 | 7/2008 | Coppi et al. |
| 7,409,159 | B2 | 8/2008 | Izadpanah |
| 7,412,224 | B2 | 8/2008 | Kotola et al. |
| 7,424,228 | B1 | 9/2008 | Williams et al. |
| 7,442,679 | B2 | 10/2008 | Stolle et al. |
| 7,444,051 | B2 | 10/2008 | Tatat et al. |
| 7,450,853 | B2 | 11/2008 | Kim et al. |
| 7,450,854 | B2 | 11/2008 | Lee et al. |
| 7,451,365 | B2 | 11/2008 | Wang et al. |
| 7,457,646 | B2 | 11/2008 | Mahany et al. |
| 7,460,507 | B2 | 12/2008 | Kubler et al. |
| 7,460,829 | B2 | 12/2008 | Utsumi et al. |
| 7,460,831 | B2 | 12/2008 | Hasarchi |
| 7,466,925 | B2 | 12/2008 | Iannelli |
| 7,469,105 | B2 | 12/2008 | Wake et al. |
| 7,477,597 | B2 | 1/2009 | Segel |
| 7,483,504 | B2 | 1/2009 | Shapira et al. |
| 7,493,129 | B1 | 2/2009 | Mostafa et al. |
| 7,496,070 | B2 | 2/2009 | Vesuna |
| 7,496,384 | B2 | 2/2009 | Seto et al. |
| 7,522,552 | B2 | 4/2009 | Fein et al. |
| 7,542,452 | B2 | 6/2009 | Penumetsa |
| 7,548,695 | B2 | 6/2009 | Wake |
| 7,551,641 | B2 | 6/2009 | Pirzada et al. |
| 7,552,246 | B2 | 6/2009 | Mahany et al. |
| 7,557,758 | B2 | 7/2009 | Rofougaran |
| 7,580,384 | B2 | 8/2009 | Kubler et al. |
| 7,586,861 | B2 | 9/2009 | Kubler et al. |
| 7,590,354 | B2 | 9/2009 | Sauer et al. |
| 7,599,420 | B2 | 10/2009 | Forenza et al. |
| 7,606,594 | B2 | 10/2009 | Jesse et al. |
| 7,627,250 | B2 | 12/2009 | George et al. |
| 7,630,690 | B2 | 12/2009 | Kaewell, Jr. et al. |
| 7,633,934 | B2 | 12/2009 | Kubler et al. |
| 7,646,743 | B2 | 1/2010 | Kubler et al. |
| 7,646,777 | B2 | 1/2010 | Hicks, III et al. |
| 7,653,397 | B2 | 1/2010 | Pernu et al. |
| 7,668,153 | B2 | 2/2010 | Zavadsky |
| 7,668,565 | B2 | 2/2010 | Ylänen et al. |
| 7,684,709 | B2 | 3/2010 | Ray et al. |
| 7,688,811 | B2 | 3/2010 | Kubler et al. |
| 7,693,486 | B2 | 4/2010 | Kasslin et al. |
| 7,697,467 | B2 | 4/2010 | Kubler et al. |
| 7,715,375 | B2 | 5/2010 | Kubler et al. |
| 7,715,466 | B1 | 5/2010 | Oh et al. |
| 7,751,374 | B2 | 7/2010 | Donovan |
| 7,751,838 | B2 | 7/2010 | Ramesh et al. |
| 7,760,703 | B2 | 7/2010 | Kubler et al. |
| 7,761,093 | B2 | 7/2010 | Sabat, Jr. et al. |
| 7,764,978 | B1 | 7/2010 | West |
| 7,768,951 | B2 | 8/2010 | Kubler et al. |
| 7,773,573 | B2 | 8/2010 | Chung et al. |
| 7,778,603 | B2 | 8/2010 | Palin et al. |
| 7,783,263 | B2 | 8/2010 | Sperlich et al. |
| 7,787,854 | B2 | 8/2010 | Conyers et al. |
| 7,805,073 | B2 | 9/2010 | Sabat, Jr. et al. |
| 7,809,012 | B2 | 10/2010 | Ruuska et al. |
| 7,817,958 | B2 | 10/2010 | Scheinert et al. |
| 7,817,969 | B2 | 10/2010 | Castaneda et al. |
| 7,835,328 | B2 | 11/2010 | Stephens et al. |
| 7,844,273 | B2 | 11/2010 | Scheinert |
| 7,848,316 | B2 | 12/2010 | Kubler et al. |
| 7,848,731 | B1 | 12/2010 | Dianda et al. |
| 7,853,234 | B2 | 12/2010 | Afsahi |
| 7,870,321 | B2 | 1/2011 | Rofougaran |
| 7,881,755 | B1 | 2/2011 | Mishra et al. |
| 7,894,423 | B2 | 2/2011 | Kubler et al. |
| 7,899,007 | B2 | 3/2011 | Kubler et al. |
| 7,907,972 | B2 | 3/2011 | Walton et al. |
| 7,912,043 | B2 | 3/2011 | Kubler et al. |
| 7,916,706 | B2 | 3/2011 | Kubler et al. |
| 7,917,145 | B2 | 3/2011 | Mahany et al. |
| 7,920,553 | B2 | 4/2011 | Kubler et al. |
| 7,920,858 | B2 | 4/2011 | Sabat, Jr. et al. |
| 7,924,783 | B1 | 4/2011 | Mahany et al. |
| 7,929,940 | B1 | 4/2011 | Dianda et al. |
| 7,936,713 | B2 | 5/2011 | Kubler et al. |
| 7,948,897 | B2 | 5/2011 | Stuart et al. |
| 7,949,364 | B2 | 5/2011 | Kasslin et al. |
| 7,957,777 | B1 | 6/2011 | Vu et al. |
| 7,962,042 | B2 | 6/2011 | Deas |
| 7,962,176 | B2 | 6/2011 | Li et al. |
| 7,969,009 | B2 | 6/2011 | Chandrasekaran |
| 7,969,911 | B2 | 6/2011 | Mahany et al. |
| 7,990,925 | B2 | 8/2011 | Tinnakornsrisuphap et al. |
| 7,996,020 | B1 | 8/2011 | Chhabra |
| 8,005,152 | B2 | 8/2011 | Wegener |
| 8,010,116 | B2 | 8/2011 | Scheinert |
| 8,018,907 | B2 | 9/2011 | Kubler et al. |
| 8,036,308 | B2 | 10/2011 | Rofougaran |
| 8,082,353 | B2 | 12/2011 | Huber et al. |
| 8,086,192 | B2 | 12/2011 | Rofougaran et al. |
| 8,107,464 | B2 | 1/2012 | Schmidt et al. |
| 8,135,102 | B2 | 3/2012 | Wiwel et al. |
| 8,155,525 | B2 | 4/2012 | Cox |
| 8,174,428 | B2 | 5/2012 | Wegener |
| 8,208,434 | B2 | 6/2012 | Sayana et al. |
| 8,213,401 | B2 | 7/2012 | Fischer et al. |
| 8,270,387 | B2 | 9/2012 | Cannon et al. |
| 8,274,929 | B2 | 9/2012 | Schmidt et al. |
| 8,279,800 | B2 | 10/2012 | Schmidt et al. |
| 8,290,483 | B2 | 10/2012 | Sabat, Jr. et al. |
| 8,306,563 | B2 | 11/2012 | Zavadsky et al. |
| 8,346,091 | B2 | 1/2013 | Kummetz et al. |
| 8,346,160 | B2 | 1/2013 | Kummetz |
| 8,346,278 | B2 | 1/2013 | Wala et al. |
| 8,422,884 | B2 | 4/2013 | Mao |
| 8,428,510 | B2 | 4/2013 | Stratford et al. |
| 8,457,562 | B2 | 6/2013 | Zavadsky et al. |
| 8,462,683 | B2 | 6/2013 | Uyehara et al. |
| 8,467,823 | B2 | 6/2013 | Seki et al. |
| 8,472,579 | B2 | 6/2013 | Uyehara et al. |
| 8,509,215 | B2 | 8/2013 | Stuart |
| 8,509,850 | B2 | 8/2013 | Zavadsky et al. |
| 8,526,970 | B2 | 9/2013 | Wala et al. |
| 8,532,242 | B2 | 9/2013 | Fischer et al. |
| 8,532,566 | B2 | 9/2013 | Dussmann |
| 8,548,526 | B2 | 10/2013 | Schmidt et al. |
| 8,583,100 | B2 | 11/2013 | Koziy et al. |
| 8,606,110 | B2 | 12/2013 | Rospsha et al. |
| 8,626,245 | B2 | 1/2014 | Zavadsky et al. |
| 8,634,766 | B2 | 1/2014 | Hobbs et al. |
| 8,681,917 | B2 | 3/2014 | McAllister et al. |
| 8,682,338 | B2 | 3/2014 | Lemson et al. |
| 8,693,342 | B2 | 4/2014 | Uyehara et al. |
| 8,694,034 | B2 | 4/2014 | Notargiacomo |
| 8,699,982 | B2 | 4/2014 | Singh |
| 8,737,300 | B2 | 5/2014 | Stapleton et al. |
| 8,737,454 | B2 | 5/2014 | Wala et al. |
| 8,743,718 | B2 | 6/2014 | Grenier et al. |
| 8,743,756 | B2 | 6/2014 | Uyehara et al. |
| 8,792,933 | B2 | 7/2014 | Chen |
| 8,837,659 | B2 | 9/2014 | Uyehara et al. |
| 8,837,940 | B2 | 9/2014 | Smith et al. |
| 8,908,607 | B2 | 12/2014 | Kummetz et al. |
| 8,929,288 | B2 | 1/2015 | Stewart et al. |
| 8,948,816 | B2 | 2/2015 | Fischer et al. |
| 8,958,789 | B2 | 2/2015 | Bauman et al. |
| 8,976,067 | B2 | 3/2015 | Fischer |
| 9,001,811 | B2 | 4/2015 | Wala et al. |
| 9,037,143 | B2 | 5/2015 | Berlin et al. |
| 9,042,732 | B2 | 5/2015 | Cune et al. |
| 9,270,374 | B2 | 2/2016 | Cune et al. |
| 9,325,429 | B2 | 4/2016 | Berlin et al. |
| 9,525,488 | B2 | 12/2016 | Beamon et al. |
| 9,602,176 | B2 | 3/2017 | Schmid et al. |
| 9,642,102 | B2 | 5/2017 | Machida |
| 9,806,797 | B2 | 10/2017 | Berlin et al. |
| 2001/0000621 | A1 | 5/2001 | Mitsuda et al. |

(56) References Cited

U.S. PATENT DOCUMENTS

2001/0036163 A1 11/2001 Sabat, Jr. et al.
2001/0053011 A1 12/2001 Imajo
2002/0003645 A1 1/2002 Kim et al.
2002/0012336 A1 1/2002 Hughes et al.
2002/0012495 A1 1/2002 Sasai et al.
2002/0031113 A1 3/2002 Dodds et al.
2002/0048071 A1 4/2002 Suzuki et al.
2002/0055371 A1 5/2002 Arnon et al.
2002/0075906 A1 6/2002 Cole et al.
2002/0090915 A1 7/2002 Komara et al.
2002/0092347 A1 7/2002 Niekerk et al.
2002/0111149 A1 8/2002 Shoki
2002/0111192 A1 8/2002 Thomas et al.
2002/0114038 A1 8/2002 Amon et al.
2002/0123365 A1 9/2002 Thorson et al.
2002/0126967 A1 9/2002 Panak et al.
2002/0130778 A1 9/2002 Nicholson
2002/0176354 A1 11/2002 Chiodini
2002/0181668 A1 12/2002 Masoian et al.
2002/0190845 A1 12/2002 Moore
2003/0007214 A1 1/2003 Aburakawa et al.
2003/0016418 A1 1/2003 Westbrook et al.
2003/0045284 A1 3/2003 Copley et al.
2003/0078052 A1 4/2003 Atias et al.
2003/0078074 A1 4/2003 Sesay et al.
2003/0141962 A1 7/2003 Barink
2003/0161637 A1 8/2003 Yamamoto et al.
2003/0165287 A1 9/2003 Krill et al.
2003/0174099 A1 9/2003 Bauer et al.
2003/0209601 A1 11/2003 Chung
2004/0001719 A1 1/2004 Sasaki
2004/0008114 A1 1/2004 Sawyer
2004/0017785 A1 1/2004 Zelst
2004/0037300 A1 2/2004 Lehr et al.
2004/0041714 A1 3/2004 Forster
2004/0043764 A1 3/2004 Bigham et al.
2004/0047313 A1 3/2004 Rumpf et al.
2004/0049321 A1 3/2004 Lehr et al.
2004/0078151 A1 4/2004 Aljadeff et al.
2004/0090366 A1* 5/2004 Wong ..... H01Q 1/243
343/700 MS
2004/0100930 A1 5/2004 Shapira et al.
2004/0105435 A1 6/2004 Morioka
2004/0106435 A1 6/2004 Bauman et al.
2004/0110469 A1 6/2004 Judd et al.
2004/0126068 A1 7/2004 Van Bijsterveld
2004/0131125 A1 7/2004 Sanderford, Jr. et al.
2004/0146020 A1 7/2004 Kubler et al.
2004/0149736 A1 8/2004 Clothier
2004/0151164 A1 8/2004 Kubler et al.
2004/0151503 A1 8/2004 Kashima et al.
2004/0157623 A1 8/2004 Splett
2004/0160912 A1 8/2004 Kubler et al.
2004/0160913 A1 8/2004 Kubler et al.
2004/0162115 A1 8/2004 Smith et al.
2004/0162116 A1 8/2004 Han et al.
2004/0165573 A1 8/2004 Kubler et al.
2004/0175173 A1 9/2004 Deas
2004/0175177 A1 9/2004 Lee et al.
2004/0198451 A1 10/2004 Varghese
2004/0202257 A1 10/2004 Mehta et al.
2004/0203339 A1 10/2004 Bauman
2004/0203704 A1 10/2004 Ommodt et al.
2004/0203846 A1 10/2004 Caronni et al.
2004/0204109 A1 10/2004 Hoppenstein
2004/0208526 A1 10/2004 Mibu
2004/0218873 A1 11/2004 Nagashima et al.
2004/0230846 A1 11/2004 Mancey et al.
2004/0233877 A1 11/2004 Lee et al.
2004/0258105 A1 12/2004 Spathas et al.
2005/0052287 A1 3/2005 Whitesmith et al.
2005/0058451 A1 3/2005 Ross
2005/0068179 A1 3/2005 Roesner
2005/0076982 A1 4/2005 Metcalf et al.
2005/0078006 A1 4/2005 Hutchins et al.
2005/0093679 A1 5/2005 Zai et al.
2005/0099343 A1 5/2005 Asrani et al.
2005/0116821 A1 6/2005 Wilsey et al.
2005/0141545 A1 6/2005 Fein et al.
2005/0143077 A1 6/2005 Charbonneau
2005/0147071 A1 7/2005 Karaoguz et al.
2005/0148306 A1 7/2005 Hiddink
2005/0159108 A1 7/2005 Fletcher et al.
2005/0174236 A1 8/2005 Brookner
2005/0201761 A1 9/2005 Bartur et al.
2005/0219050 A1 10/2005 Martin
2005/0220458 A1 10/2005 Kupershmidt et al.
2005/0224585 A1 10/2005 Durrant et al.
2005/0226625 A1 10/2005 Wake et al.
2005/0232636 A1 10/2005 Durrant et al.
2005/0242188 A1 11/2005 Vesuna
2005/0252971 A1 11/2005 Howarth et al.
2005/0266797 A1 12/2005 Utsumi et al.
2005/0266854 A1 12/2005 Niiho et al.
2005/0269930 A1 12/2005 Shimizu et al.
2005/0271396 A1 12/2005 Iannelli
2006/0002326 A1 1/2006 Vesuna
2006/0014548 A1 1/2006 Bolin et al.
2006/0017633 A1 1/2006 Pronkine
2006/0019604 A1 1/2006 Hasarchi
2006/0045054 A1 3/2006 Utsumi et al.
2006/0053324 A1 3/2006 Giat et al.
2006/0062579 A1 3/2006 Kim et al.
2006/0079290 A1 4/2006 Seto et al.
2006/0094470 A1 5/2006 Wake et al.
2006/0104643 A1 5/2006 Lee et al.
2006/0159388 A1 7/2006 Kawase et al.
2006/0182446 A1 8/2006 Kim et al.
2006/0182449 A1 8/2006 Iannelli et al.
2006/0189354 A1 8/2006 Lee et al.
2006/0222369 A1 10/2006 Kim et al.
2006/0233506 A1 10/2006 Noonan et al.
2006/0239630 A1 10/2006 Hase et al.
2006/0267843 A1 11/2006 Sakama et al.
2006/0274704 A1 12/2006 Desai et al.
2007/0008939 A1 1/2007 Fischer
2007/0009266 A1 1/2007 Bothwell et al.
2007/0058978 A1 3/2007 Lee et al.
2007/0060045 A1 3/2007 Prautzsch
2007/0060055 A1 3/2007 Desai et al.
2007/0071128 A1 3/2007 Meir et al.
2007/0076649 A1 4/2007 Lin et al.
2007/0093273 A1 4/2007 Cai
2007/0149250 A1 6/2007 Crozzoli et al.
2007/0157251 A1 7/2007 Shrivastava et al.
2007/0166042 A1 7/2007 Seeds et al.
2007/0208961 A1 9/2007 Ghoshal et al.
2007/0224954 A1 9/2007 Gopi
2007/0243899 A1 10/2007 Hermel et al.
2007/0248358 A1 10/2007 Sauer
2007/0253714 A1 11/2007 Seeds et al.
2007/0257796 A1 11/2007 Easton et al.
2007/0264009 A1 11/2007 Sabat, Jr. et al.
2007/0274279 A1 11/2007 Wood et al.
2007/0285239 A1 12/2007 Easton et al.
2007/0286599 A1 12/2007 Sauer et al.
2007/0297005 A1 12/2007 Montierth et al.
2008/0007453 A1 1/2008 Vassilakis et al.
2008/0013909 A1 1/2008 Kostet et al.
2008/0013956 A1 1/2008 Ware et al.
2008/0013957 A1 1/2008 Akers et al.
2008/0014948 A1 1/2008 Scheinert
2008/0014992 A1 1/2008 Pescod et al.
2008/0026765 A1 1/2008 Charbonneau
2008/0031628 A1 2/2008 Dragas et al.
2008/0043714 A1 2/2008 Pernu
2008/0043784 A1 2/2008 Wilcox
2008/0044186 A1 2/2008 George et al.
2008/0056167 A1 3/2008 Kim et al.
2008/0058018 A1 3/2008 Scheinert
2008/0063387 A1 3/2008 Yahata et al.
2008/0080863 A1 4/2008 Sauer et al.
2008/0094285 A1* 4/2008 Hansen ..... H01Q 1/32
343/700 MS

(56) References Cited

U.S. PATENT DOCUMENTS

2008/0098203 A1 4/2008 Master et al.
2008/0118014 A1 5/2008 Reunamaki et al.
2008/0119198 A1 5/2008 Hettstedt et al.
2008/0124086 A1 5/2008 Matthews
2008/0124087 A1 5/2008 Hartmann et al.
2008/0129634 A1 6/2008 Pera et al.
2008/0134194 A1 6/2008 Liu
2008/0145061 A1 6/2008 Lee et al.
2008/0150514 A1 6/2008 Codreanu et al.
2008/0159226 A1 7/2008 He et al.
2008/0159744 A1 7/2008 Soto et al.
2008/0165720 A1 7/2008 Hu et al.
2008/0166094 A1 7/2008 Bookbinder et al.
2008/0168283 A1 7/2008 Penning
2008/0181282 A1 7/2008 Wala et al.
2008/0194226 A1 8/2008 Rivas et al.
2008/0207253 A1 8/2008 Jaakkola et al.
2008/0212969 A1 9/2008 Fasshauer et al.
2008/0219670 A1 9/2008 Kim et al.
2008/0232799 A1 9/2008 Kim
2008/0247716 A1 10/2008 Thomas et al.
2008/0253351 A1 10/2008 Pernu et al.
2008/0253773 A1 10/2008 Zheng
2008/0260388 A1 10/2008 Kim et al.
2008/0261656 A1 10/2008 Bella et al.
2008/0268833 A1 10/2008 Huang et al.
2008/0273844 A1 11/2008 Kewitsch
2008/0279137 A1 11/2008 Pernu et al.
2008/0279299 A1 11/2008 Reuven et al.
2008/0280569 A1 11/2008 Hazani et al.
2008/0291830 A1 11/2008 Pernu et al.
2008/0292322 A1 11/2008 Daghighian et al.
2008/0298813 A1 12/2008 Song et al.
2008/0304831 A1 12/2008 Miller, II et al.
2008/0310848 A1 12/2008 Yasuda et al.
2008/0311944 A1 12/2008 Hansen et al.
2009/0022304 A1 1/2009 Kubler et al.
2009/0028087 A1 1/2009 Nguyen et al.
2009/0028317 A1 1/2009 Ling et al.
2009/0041413 A1 2/2009 Hurley
2009/0047023 A1 2/2009 Pescod et al.
2009/0059903 A1 3/2009 Kubler et al.
2009/0061796 A1 3/2009 Arkko et al.
2009/0061939 A1 3/2009 Andersson et al.
2009/0073916 A1 3/2009 Zhang et al.
2009/0081985 A1 3/2009 Rofougaran et al.
2009/0086693 A1 4/2009 Kennedy
2009/0087181 A1 4/2009 Gray
2009/0088072 A1 4/2009 Rofougaran et al.
2009/0092394 A1 4/2009 Wei et al.
2009/0097855 A1 4/2009 Thelen et al.
2009/0135078 A1 5/2009 Lindmark et al.
2009/0149221 A1 6/2009 Liu et al.
2009/0154621 A1 6/2009 Shapira et al.
2009/0169163 A1 7/2009 Abbott, III et al.
2009/0175214 A1 7/2009 Sfar et al.
2009/0180407 A1 7/2009 Sabat et al.
2009/0180423 A1 7/2009 Kroener
2009/0180426 A1 7/2009 Sabat et al.
2009/0218407 A1 9/2009 Rofougaran
2009/0218657 A1 9/2009 Rofougaran
2009/0221249 A1 9/2009 Aue et al.
2009/0238307 A1 9/2009 Singh
2009/0245084 A1 10/2009 Moffatt et al.
2009/0245153 A1 10/2009 Li et al.
2009/0245221 A1 10/2009 Piipponen
2009/0252136 A1 10/2009 Mahany et al.
2009/0252204 A1 10/2009 Shatara et al.
2009/0252205 A1 10/2009 Rheinfelder et al.
2009/0258652 A1 10/2009 Lambert et al.
2009/0285147 A1 11/2009 Subasic et al.
2009/0290632 A1 11/2009 Wegener
2009/0316609 A1 12/2009 Singh
2010/0002626 A1 1/2010 Schmidt et al.
2010/0002661 A1 1/2010 Schmidt et al.
2010/0009394 A1 1/2010 Guo
2010/0009694 A1 1/2010 Fischer
2010/0027443 A1 2/2010 LoGalbo et al.
2010/0054227 A1 3/2010 Hettstedt et al.
2010/0056200 A1 3/2010 Tolonen
2010/0067426 A1 3/2010 Voschina et al.
2010/0067906 A1 3/2010 Adhikari et al.
2010/0080154 A1 4/2010 Noh et al.
2010/0080182 A1 4/2010 Kubler et al.
2010/0083330 A1 4/2010 Bernstein et al.
2010/0087227 A1 4/2010 Francos et al.
2010/0091475 A1 4/2010 Toms et al.
2010/0118864 A1 5/2010 Kubler et al.
2010/0127937 A1 5/2010 Chandrasekaran et al.
2010/0134257 A1 6/2010 Puleston et al.
2010/0144337 A1 6/2010 Dean
2010/0148373 A1 6/2010 Chandrasekaran
2010/0150034 A1 6/2010 Song et al.
2010/0156721 A1 6/2010 Alamouti et al.
2010/0177759 A1 7/2010 Fischer et al.
2010/0177760 A1 7/2010 Cannon et al.
2010/0188998 A1 7/2010 Pernu et al.
2010/0189439 A1 7/2010 Novak et al.
2010/0190509 A1 7/2010 Davis
2010/0196013 A1 8/2010 Franklin
2010/0202326 A1 8/2010 Rofougaran et al.
2010/0202356 A1 8/2010 Fischer et al.
2010/0208777 A1 8/2010 Ogaz
2010/0215028 A1 8/2010 Fischer
2010/0225413 A1 9/2010 Rofougaran et al.
2010/0225556 A1 9/2010 Rofougaran et al.
2010/0225557 A1 9/2010 Rofougaran et al.
2010/0232323 A1 9/2010 Kubler et al.
2010/0246558 A1 9/2010 Harel
2010/0255774 A1 10/2010 Kenington
2010/0258949 A1 10/2010 Henderson et al.
2010/0260063 A1 10/2010 Kubler et al.
2010/0278530 A1 11/2010 Kummetz et al.
2010/0290355 A1 11/2010 Roy et al.
2010/0290787 A1 11/2010 Cox
2010/0291949 A1 11/2010 Shapira et al.
2010/0296458 A1 11/2010 Wala et al.
2010/0296816 A1 11/2010 Larsen
2010/0309049 A1 12/2010 Reunamäki et al.
2010/0311472 A1 12/2010 Rofougaran et al.
2010/0311480 A1 12/2010 Raines et al.
2010/0316609 A1 12/2010 Dewhurst et al.
2010/0329161 A1 12/2010 Ylanen et al.
2010/0329166 A1 12/2010 Mahany et al.
2011/0007724 A1 1/2011 Mahany et al.
2011/0007733 A1 1/2011 Kubler et al.
2011/0008042 A1 1/2011 Stewart
2011/0021146 A1 1/2011 Pernu
2011/0021224 A1 1/2011 Koskinen et al.
2011/0045767 A1 2/2011 Rofougaran et al.
2011/0055875 A1 3/2011 Zussman
2011/0065450 A1 3/2011 Kazmi
2011/0069668 A1 3/2011 Chion et al.
2011/0070821 A1 3/2011 Chun et al.
2011/0071734 A1 3/2011 Van Wiemeersch et al.
2011/0086614 A1 4/2011 Brisebois et al.
2011/0105016 A1 5/2011 Saito et al.
2011/0116393 A1 5/2011 Hong et al.
2011/0116572 A1 5/2011 Lee et al.
2011/0126071 A1 5/2011 Han et al.
2011/0135308 A1 6/2011 Tarlazzi et al.
2011/0141895 A1 6/2011 Zhang
2011/0149879 A1 6/2011 Noriega et al.
2011/0158297 A1 6/2011 Ding et al.
2011/0158298 A1 6/2011 Djadi et al.
2011/0170577 A1 7/2011 Anvari
2011/0170619 A1 7/2011 Anvari
2011/0182230 A1 7/2011 Ohm et al.
2011/0182255 A1 7/2011 Kim et al.
2011/0194475 A1 8/2011 Kim et al.
2011/0201368 A1 8/2011 Faccin et al.
2011/0204504 A1 8/2011 Henderson et al.
2011/0211439 A1 9/2011 Manpuria et al.
2011/0215901 A1 9/2011 Van Wiemeersch et al.

(56) References Cited

U.S. PATENT DOCUMENTS

2011/0222415 A1 9/2011 Ramamurthi et al.
2011/0222434 A1 9/2011 Chen
2011/0222619 A1 9/2011 Ramamurthi et al.
2011/0223958 A1 9/2011 Chen et al.
2011/0223959 A1 9/2011 Chen
2011/0223960 A1 9/2011 Chen et al.
2011/0223961 A1 9/2011 Chen et al.
2011/0227795 A1 9/2011 Lopez et al.
2011/0236024 A1 9/2011 Mao
2011/0237178 A1 9/2011 Seki et al.
2011/0241881 A1 10/2011 Badinelli
2011/0243201 A1 10/2011 Phillips et al.
2011/0243291 A1 10/2011 McAllister et al.
2011/0244887 A1 10/2011 Dupray et al.
2011/0256878 A1 10/2011 Zhu et al.
2011/0268033 A1 11/2011 Boldi et al.
2011/0268446 A1 11/2011 Cune et al.
2011/0268449 A1 11/2011 Berlin et al.
2011/0268452 A1 11/2011 Beamon et al.
2011/0274021 A1 11/2011 He et al.
2011/0281536 A1 11/2011 Lee et al.
2011/0316755 A1 12/2011 Ayatollahi et al.
2012/0106657 A1 5/2012 Fischer et al.
2012/0139793 A1 6/2012 Sharawi
2012/0140690 A1 6/2012 Choi et al.
2012/0177026 A1 7/2012 Uyehara et al.
2012/0263098 A1 10/2012 Takahashi et al.
2012/0296816 A1 11/2012 Kim et al.
2012/0307719 A1 12/2012 Nakasato
2012/0314797 A1 12/2012 Kummetz et al.
2012/0314813 A1 12/2012 Loyez et al.
2012/0322477 A1 12/2012 Kang et al.
2013/0012195 A1 1/2013 Sabat, Jr. et al.
2013/0017863 A1 1/2013 Kummetz et al.
2013/0034358 A1 2/2013 Sung et al.
2013/0040676 A1 2/2013 Kang et al.
2013/0089336 A1 4/2013 Dahlfort et al.
2013/0095870 A1 4/2013 Phillips et al.
2013/0107763 A1 5/2013 Uyehara et al.
2013/0114963 A1 5/2013 Stapleton et al.
2013/0121703 A1 5/2013 Kummetz et al.
2013/0150063 A1 6/2013 Berlin et al.
2013/0188753 A1 7/2013 Tarlazzi et al.
2013/0188959 A1 7/2013 Cune et al.
2013/0195467 A1 8/2013 Schmid et al.
2013/0210490 A1 8/2013 Fischer et al.
2013/0236180 A1 9/2013 Kim et al.
2013/0272202 A1 10/2013 Stapleton et al.
2013/0330086 A1 12/2013 Berlin et al.
2014/0006931 A1 1/2014 Pettitt et al.
2014/0016583 A1 1/2014 Smith
2014/0036770 A1 2/2014 Stapleton et al.
2014/0050482 A1 2/2014 Berlin et al.
2014/0050483 A1 2/2014 Berlin et al.
2014/0057627 A1 2/2014 Hejazi et al.
2014/0069318 A1 3/2014 Johnson et al.
2014/0079112 A1 3/2014 Ranson et al.
2014/0105056 A1 4/2014 Li et al.
2014/0112667 A1 4/2014 Neukirch et al.
2014/0140225 A1 5/2014 Wala
2014/0146797 A1 5/2014 Zavadsky et al.
2014/0146905 A1 5/2014 Zavadsky et al.
2014/0146906 A1 5/2014 Zavadsky et al.
2014/0150063 A1 5/2014 Bone
2014/0204900 A1 7/2014 Kawasaki
2014/0219140 A1 8/2014 Uyehara et al.
2014/0241224 A1 8/2014 Fischer et al.
2014/0243033 A1 8/2014 Wala et al.
2014/0248050 A1 9/2014 Crilly, Jr. et al.
2014/0269318 A1 9/2014 Hasarchi et al.
2014/0269859 A1 9/2014 Hanson et al.
2014/0286643 A1 9/2014 George et al.
2014/0287677 A1 9/2014 Machida
2014/0308043 A1 10/2014 Heidler et al.
2014/0308044 A1 10/2014 Heidler et al.
2014/0314061 A1 10/2014 Trajkovic et al.
2015/0049663 A1 2/2015 Mukherjee et al.
2015/0098351 A1 4/2015 Zavadsky et al.
2015/0098372 A1 4/2015 Zavadsky et al.
2015/0098419 A1 4/2015 Zavadsky et al.
2015/0155942 A1 6/2015 Baker et al.
2015/0180575 A1 6/2015 Bruckman
2015/0382292 A1 12/2015 Heidler et al.
2016/0013844 A1 1/2016 Berlin et al.
2016/0036505 A1 2/2016 George et al.
2016/0080082 A1 3/2016 Lemson et al.
2016/0087724 A1 3/2016 Liu et al.
2016/0134348 A1 5/2016 George et al.
2016/0173201 A1 6/2016 Cune et al.
2016/0204878 A1 7/2016 Goodwill
2016/0219591 A1 7/2016 Lee et al.
2016/0295565 A1 10/2016 Kim et al.
2016/0380359 A1* 12/2016 Cooper ..... H01Q 1/38 343/767
2017/0047998 A1 2/2017 Palanisamy et al.
2017/0062952 A1* 3/2017 Sundararajan ..... H01Q 21/26
2017/0201322 A1 7/2017 Harel et al.
2017/0207853 A1 7/2017 Harel et al.
2017/0237493 A1 8/2017 Hazani et al.
2017/0244541 A1 8/2017 McAllister et al.

FOREIGN PATENT DOCUMENTS

CA 2065090 C 2/1998
CA 2242707 C 9/2002
CA 2815509 C 3/2015
CN 1745560 A 3/2006
CN 101076961 A 11/2007
CN 101090299 A 12/2007
CN 101151811 A 3/2008
CN 101296525 A 10/2008
CN 101346006 A 1/2009
CN 101496306 A 7/2009
CN 101542928 A 9/2009
CN 201315588 Y 9/2009
DE 19705253 A1 8/1998
DE 20104862 U1 9/2001
DE 10249414 A1 5/2004
EP 0391597 A2 10/1990
EP 0461583 A1 12/1991
EP 0477952 A2 4/1992
EP 0477952 A3 4/1992
EP 0714218 A1 5/1996
EP 0766343 A2 4/1997
EP 0687400 B1 11/1998
EP 0993124 A2 4/2000
EP 1056226 A2 11/2000
EP 1173034 A1 1/2002
EP 1202475 A2 5/2002
EP 1227605 A2 7/2002
EP 1267447 A1 12/2002
EP 1347584 A2 9/2003
EP 1363352 A1 11/2003
EP 1391897 A1 2/2004
EP 1443687 A1 8/2004
EP 1455550 A2 9/2004
EP 1501206 A1 1/2005
EP 1503451 A1 2/2005
EP 1511203 A1 3/2005
EP 1530316 A1 5/2005
EP 1267447 B1 8/2006
EP 1693974 A1 8/2006
EP 1742388 A1 1/2007
EP 1173034 B1 7/2007
EP 1954019 A1 8/2008
EP 1968250 A1 9/2008
EP 1357683 B1 5/2009
EP 2110955 A1 10/2009
EP 2253980 A1 11/2010
EP 1570626 B1 11/2013
GB 2323252 A 9/1998
GB 2366131 A 2/2002
GB 2370170 A 6/2002
GB 2399963 A 9/2004

(56) References Cited

FOREIGN PATENT DOCUMENTS

| | | | |
|---|---|---|---|
| GB | 2428149 | A | 1/2007 |
| JP | 05260018 | A | 10/1993 |
| JP | 08181661 | A | 7/1996 |
| JP | 09083450 | A | 3/1997 |
| JP | 09162810 | A | 6/1997 |
| JP | 09200840 | A | 7/1997 |
| JP | 11068675 | A | 3/1999 |
| JP | 11088265 | A | 3/1999 |
| JP | 2000152300 | A | 5/2000 |
| JP | 2000341744 | A | 12/2000 |
| JP | 2002264617 | A | 9/2002 |
| JP | 2003148653 | A | 5/2003 |
| JP | 2003172827 | A | 6/2003 |
| JP | 2004172734 | A | 6/2004 |
| JP | 2004245963 | A | 9/2004 |
| JP | 2004247090 | A | 9/2004 |
| JP | 2004264901 | A | 9/2004 |
| JP | 2004265624 | A | 9/2004 |
| JP | 2004317737 | A | 11/2004 |
| JP | 2004349184 | A | 12/2004 |
| JP | 2005018175 | A | 1/2005 |
| JP | 2005087135 | A | 4/2005 |
| JP | 2005134125 | A | 5/2005 |
| JP | 2007228603 | A | 9/2007 |
| JP | 2008172597 | A | 7/2008 |
| KR | 20040053467 | A | 6/2004 |
| KR | 20110087949 | A | 8/2011 |
| KR | 2012035459 | A | 4/2012 |
| WO | 9603823 | A1 | 2/1996 |
| WO | 9748197 | A2 | 12/1997 |
| WO | 9935788 | A2 | 7/1999 |
| WO | 0042721 | A1 | 7/2000 |
| WO | 0178434 | A1 | 10/2001 |
| WO | 0184760 | A1 | 11/2001 |
| WO | 0221183 | A1 | 3/2002 |
| WO | 0230141 | A1 | 4/2002 |
| WO | 02102102 | A1 | 12/2002 |
| WO | 03024027 | A1 | 3/2003 |
| WO | 03098175 | A1 | 11/2003 |
| WO | 2004030154 | A2 | 4/2004 |
| WO | 2004047472 | A1 | 6/2004 |
| WO | 2004056019 | A1 | 7/2004 |
| WO | 2004059934 | A1 | 7/2004 |
| WO | 2004086795 | A2 | 10/2004 |
| WO | 2004093471 | A2 | 10/2004 |
| WO | 2005062505 | A1 | 7/2005 |
| WO | 2005069203 | A2 | 7/2005 |
| WO | 2005069203 | A3 | 7/2005 |
| WO | 2005073897 | A1 | 8/2005 |
| WO | 2005079386 | A2 | 9/2005 |
| WO | 2005101701 | A2 | 10/2005 |
| WO | 2005111959 | A2 | 11/2005 |
| WO | 2005117337 | A1 | 12/2005 |
| WO | 2006011778 | A1 | 2/2006 |
| WO | 2006018592 | A1 | 2/2006 |
| WO | 2006019392 | A1 | 2/2006 |
| WO | 2006039941 | A1 | 4/2006 |
| WO | 2006046088 | A1 | 5/2006 |
| WO | 2006051262 | A1 | 5/2006 |
| WO | 2006077569 | A1 | 7/2006 |
| WO | 2006094441 | A1 | 9/2006 |
| WO | 2006133609 | A1 | 12/2006 |
| WO | 2006136811 | A1 | 12/2006 |
| WO | 2007048427 | A1 | 5/2007 |
| WO | 2007075579 | A2 | 7/2007 |
| WO | 2007077451 | A1 | 7/2007 |
| WO | 2007088561 | A1 | 8/2007 |
| WO | 2007091026 | A1 | 8/2007 |
| WO | 2008008249 | A2 | 1/2008 |
| WO | 2008027213 | A2 | 3/2008 |
| WO | 2008033298 | A2 | 3/2008 |
| WO | 2008039830 | A2 | 4/2008 |
| WO | 2009014710 | A1 | 1/2009 |
| WO | 2009100395 | A1 | 8/2009 |
| WO | 2009100396 | A1 | 8/2009 |
| WO | 2009100397 | A2 | 8/2009 |
| WO | 2009100398 | A2 | 8/2009 |
| WO | 2009145789 | A1 | 12/2009 |
| WO | 2010087919 | A2 | 8/2010 |
| WO | 2010090999 | A1 | 8/2010 |
| WO | 2011043172 | A1 | 4/2011 |
| WO | 2011112373 | A1 | 9/2011 |
| WO | 2011139937 | A1 | 11/2011 |
| WO | 2011139939 | A1 | 11/2011 |
| WO | 2011139942 | A1 | 11/2011 |
| WO | 2011160117 | A1 | 12/2011 |
| WO | 2012024345 | A2 | 2/2012 |
| WO | 2012051227 | A1 | 4/2012 |
| WO | 2012051230 | A1 | 4/2012 |
| WO | 2012054553 | A1 | 4/2012 |
| WO | 2012058182 | A1 | 5/2012 |
| WO | 2012100468 | A1 | 8/2012 |
| WO | 2012170865 | A2 | 12/2012 |
| WO | 2013009835 | A1 | 1/2013 |
| WO | 2013063025 | A1 | 5/2013 |
| WO | 2013122915 | A1 | 8/2013 |
| WO | 2014022211 | A2 | 2/2014 |
| WO | 2014070236 | A1 | 5/2014 |
| WO | 2014082070 | A1 | 5/2014 |
| WO | 2014082072 | A1 | 5/2014 |
| WO | 2014082075 | A1 | 5/2014 |
| WO | 2014144314 | A1 | 9/2014 |
| WO | 2015054162 | A1 | 4/2015 |
| WO | 2015054164 | A1 | 4/2015 |
| WO | 2015054165 | A1 | 4/2015 |

OTHER PUBLICATIONS

Advisory Action for U.S. Appl. No. 13/967,426 dated Jul. 6, 2015, 3 pages.

Examination Report for European patent application 11721160.7 dated Oct. 21, 2015, 7 pages.

Translation of the Second Office Action for Chinese patent application 201180024499.4 dated Aug. 17, 2015, 3 pages.

Advisory Action for U.S. Appl. No. 14/711,306 dated Oct. 8, 2015, 3 pages.

Non-final Office Action for U.S. Appl. No. 13/967,426 dated Sep. 17, 2015, 27 pages.

Mohammed, Maalim, et al., "New Compact Design of Dual Notched Bands UWB Antenna with Slots in Radiating and Feeding Elements," IEEE Student Conference on Research and Development, Dec. 16-17, 2013, Putrajaya, Malaysia, IEEE, pp. 374-379.

International Search Report and Written Opinion for PCT/IL2015/051205 dated Mar. 10, 2016, 14 pages.

International Search Report for PCT/IL2015/051219 dated Mar. 17, 2016, 5 pages.

International Search Report and Written Opinion for PCT/IL2015/051217 dated Mar. 17, 2016, 14 pages.

International Search Report and Written Opinion for PCT/IL2015/051095 dated Mar. 2, 2016, 14 pages.

International Search Report and Written Opinion for PCT/IL2015/051061 dated Feb. 15, 2016, 12 pages.

Notice of Allowance for U.S. Appl. No. 13/025,719 dated Aug. 11, 2016, 8 pages.

Non-final Office Action for U.S. Appl. No. 14/664,305 dated Jul. 7, 2016, 45 pages.

Final Office Action for U.S. Appl. No. 14/664,305, dated Dec. 23, 2016, 24 pages.

Non-final Office Action for U.S. Appl. No. 15/049,913 dated Jun. 16, 2016, 20 pages.

Final Office Action for U.S. Appl. No. 15/049,913, dated Nov. 25, 2016, 16 pages.

Notice of Allowance and Examiner-Initiated Interview Summary for U.S. Appl. No. 15/098,941, dated Jul. 14, 2016, 18 pages.

Corrected Notice of Allowability for U.S. Appl. No. 15/098,941, dated Jul. 27, 2016, 5 pages.

Advisory Action for U.S. Appl. No. 15/049,913, dated Feb. 15, 2017, 3 pages.

Non-Final Office Action for U.S. Appl. No. 15/381,952, dated Jan. 27, 2017, 14 pages.

(56) References Cited

OTHER PUBLICATIONS

International Search Report for PCT/IL2015/050970, dated May 9, 2016, 6 pages.
International Preliminary Report on Patentability for PCT/IL2015/050970, dated Apr. 6, 2017, 17 pages.
Non-Final Office Action for U.S. Appl. No. 14/496,507, dated Feb. 24, 2017, 15 pages.
Advisory Action for U.S. Appl. No. 14/664,305, dated Mar. 1, 2017, 3 pages.
Non-Final Office Action for U.S. Appl. No. 14/664,305, dated Apr. 7, 2017, 34 pages.
Non-Final Office Action for U.S. Appl. No. 15/332,505, dated Apr. 5, 2017, 24 pages.
Author Unknown, "Fiber Optic Distributed Antenna System," Installation and Users Guide, ERAU Version 1.5, May 2002, Andrews Corporation, 53 pages.
Translation of the First Office Action for Chinese Patent Application No. 201610029179.2, dated Jul. 27, 2017, 19 pages.
Invitation to Pay Fees for International Patent Application No. PCT/IL2015/050970, dated Feb. 17, 2016, 6 pages.
Final Office Action for U.S. Appl. No. 14/664,305, dated Sep. 5, 2017, 34 pages.
Examiner's Answer to the Appeal Brief for U.S. Appl. No. 15/049,913, dated Jun. 22, 2017, 22 pages.
Notice of Allowance for U.S. Appl. No. 15/332,505, dated Aug. 31, 2017, 8 pages.
Notice of Allowance for U.S. Appl. No. 15/381,952, dated May 9, 2017, 7 pages.
Notice of Allowance for U.S. Appl. No. 15/381,952, dated Jul. 31, 2017, 7 pages.
Final Office Action for U.S. Appl. No. 14/496,507, dated Sep. 28, 2017, 21 pages.
Non-Final Office Action for U.S. Appl. No. 15/473,827, dated Sep. 22, 2017, 38 pages.
Translation of the Second Office Action for Chinese Patent Application No. 201610029179.2, dated Feb. 1, 2018, 3 pages.
Decision on Appeal for U.S. Appl. No. 15/049,913, dated Apr. 19, 2018, 8 pages.
Non-Final Office Action for U.S. Appl. No. 15/472,909, dated Mar. 8, 2018, 18 pages.
Final Office Action for U.S. Appl. No. 15/473,827, dated Jan. 26, 2018, 40 pages.
Advisory Action for U.S. Appl. No. 15/473,827, dated Apr. 9, 2018, 3 pages.
Notice of Allowance for U.S. Appl. No. 15/475,589, dated Feb. 7, 2018, 9 pages.
Non-Final Office Action for U.S. Appl. No. 15/584,189, dated Apr. 4 , 2018, 12 pages.
Advisory Action for U.S. Appl. No. 14/664,305, dated Oct. 30, 2017, 3 pages.
Notice of Allowance for U.S. Appl. No. 14/664,305, dated Dec. 1, 2017, 19 pages.
Cooper, A.J., "Fibre/Radio for the Provision of Cordless/Mobile Telephony Services in the Access Network," Electronics Letters, 1990, pp. 2054-2056, vol. 26, No. 24.
Bakaul, M., et al., "Efficient Multiplexing Scheme for Wavelength-Interleaved DWDM Millimeter-Wave Fiber-Radio Systems," IEEE Photonics Technology Letters, Dec. 2005, vol. 17, No. 12.
Huang, C., et al., "A WLAN-Used Helical Antenna Fully Integrated with the PCMCIA Carrier," IEEE Transactions on Antennas and Propagation, Dec. 2005, vol. 53, No. 12, pp. 4164-4168.
Gibson, B.C., et al., "Evanescent Field Analysis of Air-Silica Microstructure Waveguides," The 14th Annual Meeting of the IEEE Lasers and Electro-Optics Society, 1-7803-7104-4/01, Nov. 12-13, 2001, vol. 2, pp. 709-710.
International Search Report for PCT/US07/21041 dated Mar. 7, 2008, 3 pages.
No Author, "ITU-T G.652, Telecommunication Standardization Sector of ITU, Series G: Transmission Systems and Media, Digital Systems and Networks, Transmission Media Characteristics—Optical Fibre Cables, Characteristics of a Single-Mode Optical Fiber and Cable," ITU-T Recommendation G.652, International Telecommunication Union, Jun. 2005, 20 pages.
No Author, "ITU-T G.657, Telecommunication Standardization Sector of ITU, Dec. 2006, Series G: Transmission Systems and Media, Digital Systems and Networks, Transmission Media and Optical Systems Characteristics—Optical Fibre Cables, Characteristics of a Bending Loss Insensitive Single Mode Optical Fibre and Cable for the Access Network," ITU-T Recommendation G.657, International Telecommunication Union, 19 pages.
Kojucharow, K., et al., "Millimeter-Wave Signal Properties Resulting from Electrooptical Upconversion," IEEE Transactions on Microwave Theory and Techniques, Oct. 2001, vol. 49, No. 10, pp. 1977-1985.
Monro, T.M., et al., "Holey Fibers with Random Cladding Distributions," Optics Letters, Feb. 15, 2000, vol. 25, No. 4, pp. 206-208.
Moreira, J.D., et al., "Diversity Techniques for OFDM Based WLAN Systems," The 13th IEEE International Symposium on Personal, Indoor and Mobile Radio Communications, Sep. 15-18, 2002, vol. 3, pp. 1008-1011.
Niiho, T., et al., "Multi-Channel Wireless LAN Distributed Antenna System Based on Radio-Over-Fiber Techniques," The 17th Annual Meeting of the IEEE Lasers and Electro-Optics Society, Nov. 2004, vol. 1, pp. 57-58.
Paulraj, A.J., et al., "An Overview of MIMO Communications—A Key to Gigabit Wireless," Proceedings of the IEEE, Feb. 2004, vol. 92, No. 2, 34 pages.
Pickrell, G.R., et al., "Novel Techniques for the Fabrication of Holey Optical Fibers," Proceedings of SPIE, Oct. 28-Nov. 2, 2001, vol. 4578, 2002, pp. 271-282.
Author Unknown, RFID Technology Overview, Date Unknown, 11 pages.
Roh, W., et al., "MIMO Channel Capacity for the Distributed Antenna Systems," Proceedings of the 56th IEEE Vehicular Technology Conference, Sep. 2002, vol. 2, pp. 706-709.
Seto, I., et al., "Antenna-Selective Transmit Diversity Technique for OFDM-Based WLANs with Dual-Band Printed Antennas," 2005 IEEE Wireless Communications and Networking Conference, Mar. 13-17, 2005, vol. 1, pp. 51-56.
Shen, C., et al., "Comparison of Channel Capacity for MIMO-DAS versus MIMO-CAS," The 9th Asia-Pacific Conference on Communications, Sep. 21-24, 2003, vol. 1, pp. 113-118.
Wake, D. et al., "Passive Picocell: A New Concept in Wireless Network Infrastructure," Electronics Letters, Feb. 27, 1997, vol. 33, No. 5, pp. 404-406.
Winters, J., et al., "The Impact of Antenna Diversity on the Capacity of Wireless Communication Systems," IEEE Transactions on Communications, vol. 42, No. 2/3/4, Feb./Mar./Apr. 1994, pp. 1740-1751.
Opatic, D., "Radio over Fiber Technology for Wireless Access," Ericsson, Oct. 17, 2009, 6 pages.
Notification of Grant for Chinese patent application 201190000473.1 dated Aug. 28, 2013, 4 pages.
International Search Report for PCT/US2011/034725 dated Aug. 5, 2011, 4 pages.
Non-final Office Action for U.S. Appl. No. 12/892,424 dated Nov. 5, 2012, 22 pages.
International Search Report and Written Opinion for PCT/US2011/034738 dated Jul. 27, 2011, 13 pages.
International Search Report for PCT/US2011/047821 dated Oct. 25, 2011, 4 pages.
International Preliminary Report on Patentability for PCT/US2011/047821 dated Feb. 19, 2013, 10 pages.
Non-final Office Action for U.S. Appl. No. 13/025,719 dated Sep. 11, 2013, 18 pages.
Parker et al., "Radio-over-fibre technologies arising from the Building the future Optical Network in Europe (BONE) project," IET Optoelectron., 2010, vol. 4, Issue 6, pp. 247-259.
Singh et al., "Distributed coordination with deaf neighbors: efficient medium access for 60 GHz mesh networks," IEEE INFOCOM 2010 proceedings, 9 pages.
Examination Report for European patent application 11754570.7 dated Nov. 18, 2013, 7 pages.

(56) References Cited

OTHER PUBLICATIONS

Final Office Action for U.S. Appl. No. 13/025,719 dated Dec. 31, 2013, 20 pages.
Advisory Action for U.S. Appl. No. 13/025,719 dated Mar. 14, 2014, 6 pages.
Non-final Office Action for U.S. Appl. No. 13/785,603 dated Dec. 23, 2013, 15 pages.
Final Office Action for U.S. Appl. No. 13/785,603 dated Apr. 14, 2014, 17 pages.
Advisory Action for U.S. Appl. No. 13/785,603 dated Jun. 30, 2014, 3 pages.
Non-final Office Action for U.S. Appl. No. 13/785,603 dated Sep. 9, 2014, 10 pages.
Final Office Action for U.S. Appl. No. 13/785,603 dated Dec. 4, 2014, 8 pages.
Non-final Office Action for U.S. Appl. No. 13/762,432 dated Aug. 20, 2014, 4 pages.
Notice of Allowance for U.S. Appl. No. 13/762,432 dated Dec. 24, 2014, 7 pages.
Chowdhury et al., "Multi-service Multi-carrier Broadband MIMO Distributed Antenna Systems for In-building Optical Wireless Access," Presented at the 2010 Conference on Optical Fiber Communication and National Fiber Optic Engineers Conference, Mar. 21-25, 2010, San Diego, California, IEEE, pp. 1-3.
International Search Report for PCT/US2011/055861 dated Feb. 7, 2012, 4 pages.
International Preliminary Report on Patentability for PCT/US2011/055861 dated Apr. 25, 2013, 9 pages.
International Search Report for PCT/US2011/055858 dated Feb. 7, 2012, 4 pages.
International Preliminary Report on Patentability for PCT/US2011/055858 dated Apr. 25, 2013, 8 pages.
International Search Report for PCT/US2011/034733 dated Aug. 1, 2011, 5 pages.
International Preliminary Report on Patentability for PCT/US2011/034733 dated Nov. 15, 2012, 8 pages.
First Office Action for Chinese patent application 201180024499.4 dated Dec. 1, 2014, 13 pages.
Examination Report for European patent application 11754570.7 dated Jan. 13, 2015, 5 pages.
Final Office Action for U.S. Appl. No. 13/967,426 dated Apr. 29, 2015, 22 pages.
Author Unknown, "ADC Has 3rd Generation Services Covered at CeBIT 2001," Business Wire, Mar. 20, 2001, 3 pages.
Author Unknown, "Andrew Unveils the InCell Fiber Optic Antenna System for In-Building Wireless Communications," Fiber Optics Weekly Update, Dec. 1, 2000, Information Gatekeepers Inc., pp. 3-4.
Arredondo, Albedo et al., "Techniques for Improving In-Building Radio Coverage Using Fiber-Fed Distributed Antenna Networks," IEEE 46th Vehicular Technology Conference, Atlanta, Georgia, Apr. 28-May 1, 1996, pp. 1540-1543, vol. 3.
Fitzmaurice, M. et al., "Distributed Antenna System for Mass Transit Communications," Vehicular Technology Conference, Boston, Massachusetts, Sep. 2000, IEEE, pp. 2011-2018.
Ghafouri-Shiraz, et al., "Radio on Fibre Communication Systems Based on Integrated Circuit-Antenna Modules," Microwave and Millimeter Wave Technology Proceedings, Beijing, China, Aug. 1998, IEEE, pp. 159-169.
Griffin, R.A. et al., "Radio-Over-Fiber Distribution Using an Optical Millimeter-Wave/DWDM Overlay," Optical Fiber Communication Conference, San Diego, California, Feb. 1999, IEEE, pp. 70-72.
Juntunen, J. et al., "Antenna Diversity Array Design for Mobile Communication Systems," Proceedings of the 2000 IEEE International Conference on Phased Array Systems and Technology, Dana Point, California, May 2000, IEEE, pp. 65-67.
Lee, D. et al., "Ricocheting Bluetooth," 2nd International Conference on Microwave and Millimeter Wave Technology Proceedings, Beijing, China, Sep. 2000, IEEE, pp. 432-435.
Lee, T., "A Digital Multiplexed Fiber Optic Transmission System for Analog Audio Signals," IEEE Western Canada Conference on Computer, Power, and Communications Systems in a Rural Environment, Regina, Saskatchewan, May 1991, pp. 146-149.
Schuh et al., "Hybrid Fibre Radio Access: A Network Operators Approach and Requirements," Proceedings of the 10th Microcoll Conference, Mar. 21-24, 1999, Budapest, Hungary, pp. 211-214.
Schweber, Bill, "Maintaining cellular connectivity indoors demands sophisticated design," EDN Network, Dec. 21, 2000, 2 pages, http://www.edn.com/design/integrated-circuit-design/4362776/Maintaining-cellular-connectivity-indoors-demands-sophisticated-design.
Margotte, B. et al., "Fibre Optic Distributed Antenna System for Cellular and PCN/PCS Indoor Coverage," Microwave Engineering Europe, Jun. 1998, 6 pages.
Matsunaka et al., "Point-to-multipoint Digital Local Distribution Radio System in the 21 GHz Band," KDD Technical Journal, Mar. 1991, No. 145, p. 43-54.
Translation of the First Office Action for Chinese patent application 201180039569.3 dated Jan. 16, 2015, 7 pages.
International Search Report for PCT/US2012/025337 dated May 16, 2012, 4 pages.
Non-final Office Action for U.S. Appl. No. 13/025,719 dated Mar. 31, 2015, 26 pages.
Non-final Office Action for U.S. Appl. No. 13/967,426 dated Dec. 26, 2014, 15 pages.
Patent Cooperation Treaty, International Search Report for PCT/IL2015/051061, dated May 12, 2016, 4 pages.

* cited by examiner

MULTI-BAND MONOPOLE PLANAR ANTENNAS CONFIGURED TO FACILITATE IMPROVED RADIO FREQUENCY (RF) ISOLATION IN MULTIPLE-INPUT MULTIPLE-OUTPUT (MIMO) ANTENNA ARRANGEMENT

PRIORITY APPLICATION

This application is a continuation of International Application PCT/IL2015/051061, filed Oct. 29, 2015, which claims the benefit of priority under 35 U.S.C. § 119 of U.S. Provisional Application No. 62/074,293, filed on Nov. 3, 2014, the contents of which are relied upon and incorporated herein by reference in their entireties.

BACKGROUND

The disclosure relates generally to radio frequency (RF) antennas and more particularly to multi-band RF antennas in a multiple-input multiple-output (MIMO) antenna arrangement, which may be used in a distributed antenna system (DAS).

Wireless customers are increasingly demanding multimedia data services, such as streaming videos, on client devices. Concurrently, some wireless customers use their wireless devices in areas that are poorly served by conventional cellular networks, such as inside certain buildings or areas where there is little cellular coverage. One response to the intersection of these two concerns has been the use of DASs. DASs can be particularly useful when deployed inside buildings or other indoor environments where client devices may not otherwise be able to effectively receive RF signals from a wireless service provider. DASs include remote units configured to receive and transmit communications signals to client devices. The remote units can be provided as remote antenna units configured to wirelessly receive and transmit wireless communications signals in the antenna range of the remote antenna units.

As the wireless spectrum becomes more and more crowded, remote antenna units in DASs are increasingly relying on MIMO antennas to achieve higher data rates. One technique that enables the MIMO antennas to provide higher data rates is known as spatial multiplexing. In spatial multiplexing, a high-rate signal is split into multiple streams and provided to multiple antennas for simultaneous transmissions in the same RF band. Because multiple antennas are radiating electromagnetic energy at the same time in the same RF band, this poses a challenge in terms of antenna size and the achievable RF isolation between the multiple antennas. Space separation is a commonly used technique that can provide a desired level of RF isolation between the multiple antennas. In space separation, each of the multiple antennas is placed at a separation distance that is proportionally related to the wavelength of RF used by the multiple antennas. In other words, the separation distance is inversely determined by the radio frequency used by the multiple antennas. In this regard, the lower the radio frequency used by the multiple antennas, the longer the separation distance must be between each of the multiple antennas.

No admission is made that any reference cited herein constitutes prior art. Applicant expressly reserves the right to challenge the accuracy and pertinence of any cited documents.

SUMMARY

Embodiments disclosed in the detailed description include multi-band monopole planar antennas configured to facilitate improved radio frequency (RF) isolation in multiple-input multiple-output (MIMO) antenna arrangement. The multi-band monopole planar antennas may be configured to support both a lower frequency band(s) and a higher frequency band(s) in a MIMO antenna arrangement to provide the desired RF frequency band coverage. Space separation is a conveniently used technique to provide RF isolation between MIMO antennas. However, it may be difficult to provide sufficient space separation for a lower frequency band when the MIMO antennas are placed in close proximity. In this regard, in one aspect, a multi-band monopole planar antenna is provided and configured to generate a slant 45° ("slant-45") radiation polarization in the lower frequency band. As a result, sufficient RF isolation may be achieved in the lower frequency band when a plurality of dual-band monopole planar antennas is placed in the MIMO arrangement. In another non-limiting aspect, the multi-band monopole planar antenna is configured not to support certain unused RF bands, thus facilitating height reduction in the multi-band monopole planar antenna. By configuring the dual-band monopole planar antenna to generate the slant-45 radiation polarization in the lower frequency band, a plurality of the multi-band monopole planar antennas may be placed in close proximity to each other to support MIMO operation without compromising RF performance.

One embodiment of the disclosure relates to a dual-band monopole planar antenna. The dual-band monopole planar antenna comprises a semi-elliptical shaped conductive disc having a symmetrical center axis. The dual-band monopole planar antenna also comprises a slot disposed in the semi-elliptical shaped conductive disc along a longitudinal axis substantially perpendicular to the symmetrical center axis to separate the semi-elliptical shaped conductive disc into a first conductive disc section and a second conductive disc section. The dual-band monopole planar antenna also comprises a conductive delay line having a first end feed point and a second end feed point disposed in the slot, wherein the first end feed point is conductively coupled to the first conductive disc section and the second end feed point is conductively coupled to the second conductive disc section. The dual-band monopole planar antenna also comprises a disc feed point disposed in the first conductive disc section, wherein the disc feed point is configured to receive an electrical current from an electrical current source. The conductive delay line is configured to receive the electrical current from the first conductive disc section at the first end feed point and provide the electrical current to the second conductive disc section at the second end feed point. The first conductive disc section is configured to radiate electromagnetic energy on a first RF band with a first radiation polarization in response to receiving the electrical current from the disc feed point. The second conductive disc section is configured to radiate electromagnetic energy on a second RF band having lower frequency than the first RF band with a second radiation polarization different from the first radiation polarization in response to receiving the electrical current from the second end feed point of the conductive delay line.

An additional embodiment of the disclosure relates to a dual-band antenna element. The dual-band antenna element comprises a first dual-band monopole planar antenna mounted on a first substrate. The dual-band antenna element also comprises a second dual-band monopole planar antenna mounted on a second substrate. The first dual-band monopole planar antenna and the second dual-band monopole planar antenna each comprise a respective semi-elliptical shaped conductive disc having a respective symmetrical center axis. The first dual-band monopole planar antenna and the second dual-band monopole planar antenna each also comprise a respective slot disposed in the respective semi-elliptical shaped conductive disc along a respective longitudinal axis substantially perpendicular to the respective symmetrical center axis to separate the respective semi-elliptical shaped conductive disc into a respective first conductive disc section and a respective second conductive disc section. The first dual-band monopole planar antenna and the second dual-band monopole planar antenna each also comprise a respective conductive delay line having a respective first end feed point and a respective second end feed point disposed in the respective slot, wherein the respective first end feed point is conductively coupled to the respective first conductive disc section and the respective second end feed point is conductively coupled to the respective second conductive disc section. The first dual-band monopole planar antenna and the second dual-band monopole planar antenna each also comprise a respective disc feed point disposed in the respective first conductive disc section, wherein the respective disc feed point is configured to receive an electrical current from an electrical current source. The first substrate comprises a first slot opening disposed along the respective symmetrical center axis of the first dual-band monopole planar antenna. The second substrate comprises a second slot opening disposed along the respective symmetrical center axis of the second dual-band monopole planar antenna. The second slot opening of the second substrate receives the first substrate within the first slot opening to dispose the second dual-band monopole planar antenna substantially perpendicular to the first dual-band monopole planar antenna. The first dual-band monopole planar antenna and the second dual-band monopole planar antenna are electrically coupled along an intersection of the first substrate and the second substrate. The respective disc feed point of the first dual-band monopole planar antenna and the respective disc feed point of the second dual-band monopole planar antenna are electrically coupled to provide a common feed point for the dual-band antenna element. The first dual-band monopole planar antenna and the second dual-band monopole planar antenna are configured to each generate a cylinder-shaped slant-45 total electric field when the electrical current is received at the common feed point.

An additional embodiment of the disclosure relates to a MIMO antenna. The MIMO antenna comprises a planar mounting surface. The MIMO antenna also comprises a first dual-band antenna element disposed on the planar mounting surface, wherein the first dual-band antenna element comprises at least one first dual-band monopole planar antenna having a first symmetrical center axis substantially perpendicular to the planar mounting surface and a first longitudinal axis substantially perpendicular to the first symmetrical center axis. The MIMO antenna also comprises a second dual-band antenna element disposed on the planar mounting surface, wherein the second dual-band antenna element comprises at least one second dual-band monopole planar antenna having a second symmetrical center axis substantially perpendicular to the planar mounting surface and a second longitudinal axis substantially perpendicular to the second symmetrical center axis. The second dual-band antenna element is disposed on the planar mounting surface such that the second longitudinal axis is substantially aligned with the first longitudinal axis in the first dual-band antenna element.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The drawings provide a further understanding, and are incorporated in and constitute a part of this specification. The drawings illustrate one or more embodiment(s), and together with the description serve to explain principles and operation of the various embodiments.

DETAILED DESCRIPTION

Various embodiments will be further clarified by the following examples.

Embodiments disclosed in the detailed description include multi-band monopole planar antennas configured to facilitate improved radio frequency (RF) isolation in multiple-input multiple-output (MIMO) antenna arrangement.

The multi-band monopole planar antennas may be configured to support both a lower frequency band(s) and a higher frequency band(s) in a MIMO antenna arrangement to provide the desired RF frequency band coverage. Space separation is a conveniently used technique to provide RF isolation between MIMO antennas. However, it may be difficult to provide sufficient space separation for a lower frequency band when the MIMO antennas are placed in close proximity. In this regard, in one aspect, a multi-band monopole planar antenna is provided and configured to generate a slant 45° ("slant-45") radiation polarization in the lower frequency band. As a result, sufficient RF isolation may be achieved in the lower frequency band when a plurality of dual-band monopole planar antennas is placed in the MIMO arrangement. In another non-limiting aspect, the multi-band monopole planar antenna is configured not to support certain unused RF bands, thus facilitating height reduction in the multi-band monopole planar antenna. By configuring the dual-band monopole planar antenna to generate the slant-45 radiation polarization in the lower frequency band, a plurality of the multi-band monopole planar antennas may be placed in close proximity to each other to support MIMO operation without compromising RF performance.

Figure 1:
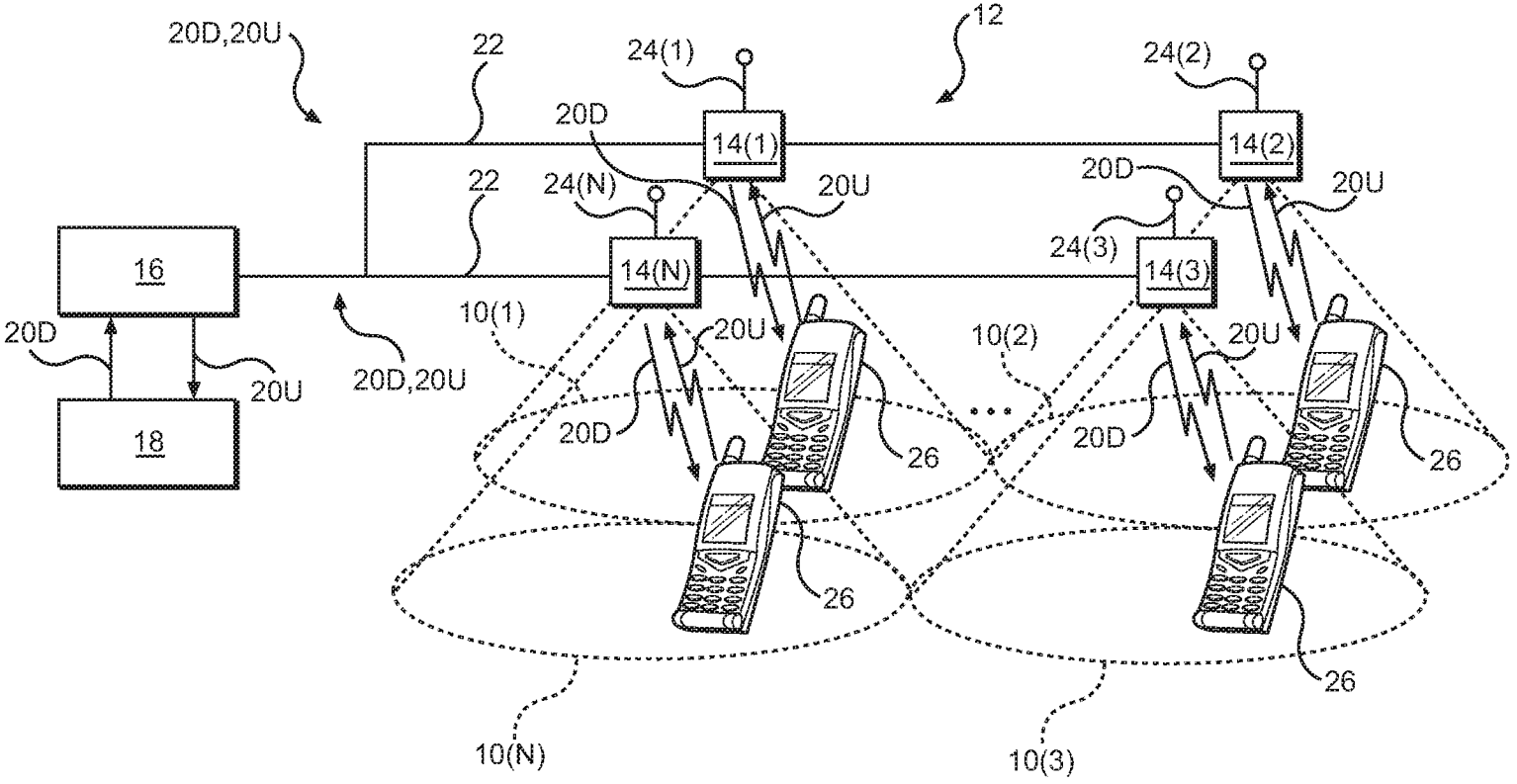
FIG. 1 is a schematic diagram of an exemplary distributed antenna system (DAS) comprising multiple-input multiple-output (MIMO) remote antenna units.
Figure 3:
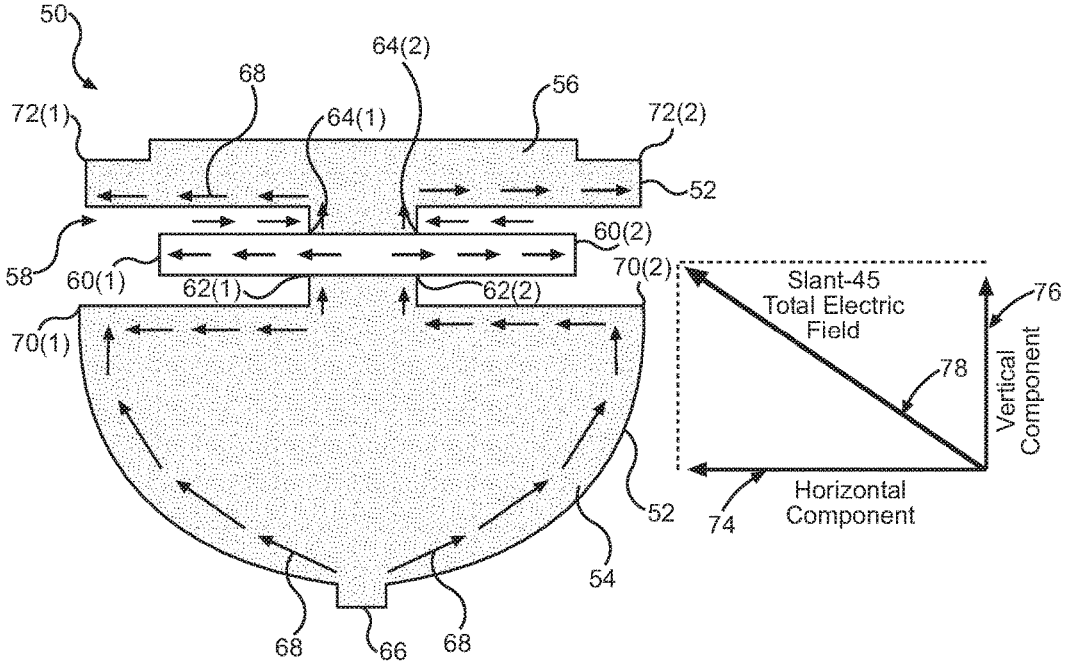
FIG. 3 is a schematic diagram of an exemplary multi-band monopole planar antenna configured to support a first radio frequency (RF) band with a vertical radiation polarization and a second RF band, which has lower frequency than the first RF band, with an approximate slant 45° (slant-45) radiation polarization to improve RF isolation in the second RF band.

In this regard, FIG. 1 illustrates the distribution of communications services to coverage areas 10(1)-10(N) of a DAS 12, wherein 'N' is the number of coverage areas. These communications services can include cellular services, wireless services such as RF identification (RFID) tracking, Wireless Fidelity (Wi-Fi), local area network (LAN), WLAN, and combinations thereof, as examples. The coverage areas 10(1)-10(N) may be remotely located. In this regard, the remote coverage areas 10(1)-10(N) are created by and centered on remote antenna units 14(1)-14(N) connected to a head-end equipment (HEE) 16 (e.g., a head-end controller or head-end unit or central unit). As will be described in more detail below, the DAS 12 is configured to support MIMO communications. In this regard, the remote antenna units 14(1)-14(N), which include one or more multi-band monopole planar antennas that are further discussed later in FIG. 3, may be placed in close proximity to each other to support MIMO operation without compromising RF performance. In this regard, the multi-band monopole planar antennas that are discussed later in FIG. 3 are configured to generate an approximate slant-45 radiation polarization in a lower frequency band. As a result, sufficient RF isolation may be achieved in the lower frequency band when the one or more multi-band monopole planar antennas that are discussed later in FIG. 3 are placed in a MIMO arrangement in the remote antenna units 14(1)-14(N).

With continuing reference to FIG. 1, the HEE 16 may be communicatively coupled to a base transceiver station (BTS) 18. In this regard, the HEE 16 receives downlink RF communications signals 20D from the BTS 18 to be distributed to the remote antenna units 14(1)-14(N). The remote antenna units 14(1)-14(N) are configured to receive the downlink RF communications signals 20D from the HEE 16 over a communications medium 22 to be distributed to the respective remote coverage areas 10(1)-10(N) of the remote antenna units 14(1)-14(N). In a non-limiting example, the communications medium 22 may be a wired communications medium, a wireless communications medium, or an optical fiber-based communications medium. Each remote antenna unit 14(1)-14(N) may include an RF transmitter/receiver (not shown) and at least one respective antenna 24(1)-24(N) operably connected to the RF transmitter/receiver to wirelessly distribute the communications services to client devices 26 within their respective remote coverage areas 10(1)-10(N). The remote antenna units 14(1)-14(N) are also configured to receive uplink RF communications signals 20U from the client devices 26 in their respective remote coverage areas 10(1)-10(N) to be distributed to the BTS 18. The size of a given remote coverage area 10(1)-10(N) is determined by the amount of RF power transmitted by the respective remote antenna units 14(1)-14(N), the receiver sensitivity, antenna gain and the RF environment, as well as by the RF transmitter/receiver sensitivity of the client devices 26. The client devices 26 usually have a fixed maximum RF receiver sensitivity, so that the above-mentioned properties of the remote antenna units 14(1)-14(N) mainly determine the size of their respective remote coverage areas 10(1)-10(N).

In the DAS 12, the downlink RF communications signals 20D may be a long-term evolution (LTE) communications signal transmitted over a large RF spectrum span. In the United States, for example, the RF spectrum allocated by the Federal Communications Commission (FCC) for LTE services ranges from 700 megahertz (MHz) to 2700 MHz. As a result, broadband antennas are often installed in the remote antenna units 14(1)-14(N) to effectively transmit and receive LTE signals over the large RF spectrum span. One type of such broadband antennas is known as a monopole planar antenna, which is discussed next.

Figure 2:
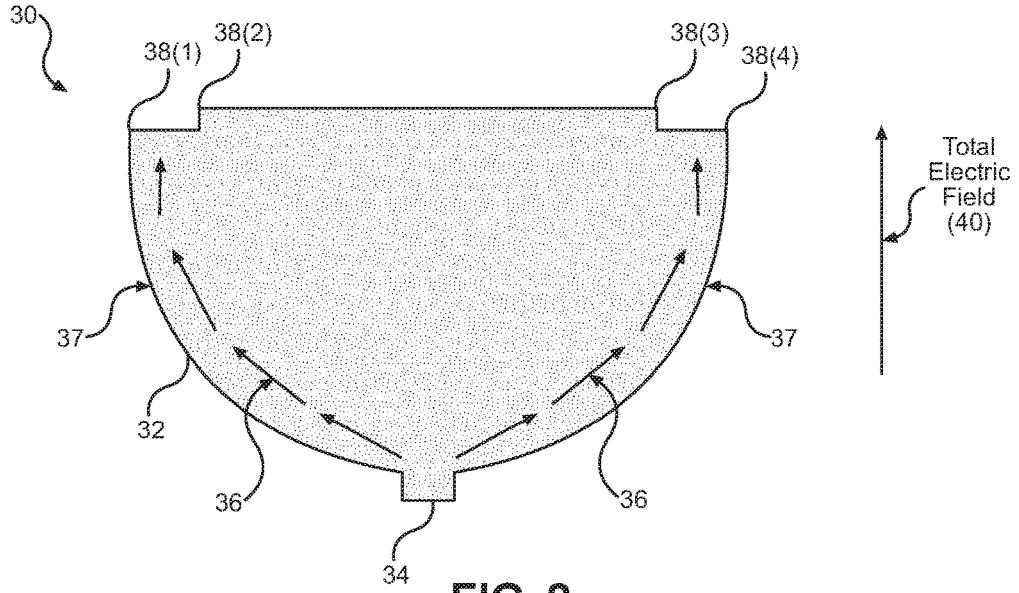
FIG. 2 Prior Art
FIG. 2 is a schematic diagram of an exemplary Vivaldi monopole planar antenna.

Before discussing examples of multi-band monopole planar antennas configured to provide sufficient isolation in close proximity starting with FIG. 3, discussions of a traditional Vivaldi monopole planar antenna are first provided with reference to FIG. 2.

In this regard, FIG. 2 provides a schematic diagram of an exemplary Vivaldi monopole planar antenna 30. The Vivaldi monopole planar antenna 30 in FIG. 2 is provided in the form of a semi-elliptical shaped conductive disc 32 in this example. The Vivaldi monopole planar antenna 30 may be configured to cover a wide range of continuous RF spectrum. For example, the Vivaldi monopole planar antenna 30 can be configured to cover a continuous RF spectrum ranging from 700 MHz to 2700 MHz. The continuous RF spectrum covered by the Vivaldi monopole planar antenna 30 is proportionally related to an impedance bandwidth of the semi-elliptical shaped conductive disc 32. In this regard, an increase in surface area of the semi-elliptical shaped conductive disc 32 will lead to an increased range of the continuous RF spectrum provided by the Vivaldi monopole planar antenna 30.

With continuing reference to FIG. 2, a disc feed point 34 extends outward from the semi-elliptical shaped conductive disc 32 and is configured to receive an electrical current 36. As illustrated in FIG. 2, when the electrical current 36 travels upward from the disc feed point 34 along the edges 37 of the semi-elliptical shaped conductive disc 32, electromagnetic energy is generated and eventually radiated outward from endpoints 38(1)-38(4). As the electrical current 36 propagates through the semi-elliptical shaped conductive disc 32, a total electric field 40 is generated. The total electric field 40 is a vector field comprising a vertical component and a horizontal component. Strengths of the vertical component and the horizontal component are proportionally related to vertically propagating electrical currents and horizontally propagating electrical currents, respectively. As illustrated in FIG. 2, the electrical current 36 is propagating predominantly in a vertical direction. As a result, the total electric field 40 has a vertical orientation. In other words, the Vivaldi monopole planar antenna 30 radiates electromagnetic energy with a vertical radiation polarization when energized by the electrical current 36.

The vertical radiation polarization produced by the Vivaldi monopole planar antenna 30 makes it difficult to achieve orthogonality among RF signals if a plurality of Vivaldi monopole planar antennas 30 were used in a MIMO antenna arrangement. The issue is especially problematic when the plurality of Vivaldi monopole planar antennas 30 is placed in close proximity and configured to operate in a lower RF band (e.g., 600 MHz or 700 MHz band). In this regard, FIG. 3 is a schematic diagram of an exemplary multi-band monopole planar antenna 50 (which is a dual-band monopole planar antenna in this example) configured to support a first RF band with a vertical radiation polarization and a second RF band, which has lower frequency than the first RF band, with an approximate slant 45° (slant-45) radiation polarization to improve RF isolation in the second RF band.

With reference to FIG. 3, the multi-band monopole planar antenna 50 comprises a semi-elliptical shaped conductive disc 52. The semi-elliptical shaped conductive disc 52 is separated into a first conductive disc section 54 and a second conductive disc section 56 by a slot 58 that is disposed along a longitudinal axis substantially perpendicular to a symmetrical center axis of the semi-elliptical shaped conductive disc 52. As previously discussed in FIG. 2, the semi-elliptical shaped conductive disc 32 enables the Vivaldi monopole planar antenna 30 to cover a continuous RF spectrum ranging from 600 MHz to 2700 MHz. Thus, by separating the semi-elliptical shaped conductive disc 52 into the first conductive disc section 54 and the second conductive disc section 56, the multi-band monopole planar antenna 50 is configured to support two separate RF bands of narrower bandwidth as opposed to one continuous RF band of wider bandwidth. In this regard, the multi-band monopole planar antenna 50 is a modified version of the Vivaldi monopole planar antenna 30 of FIG. 2.

With continuing reference to FIG. 3, the first conductive disc section 54 is configured to radiate electromagnetic energy in a first RF band. The second conductive disc section 56 is configured to radiate electromagnetic energy in a second RF band that has lower frequency than the first RF band. In a non-limiting example, the first RF band ranges from 1700 MHz to 2700 MHz (hereinafter referred to as the "higher RF band") and the second RF band ranges from 698 MHz to 894 MHz (hereinafter referred to as the "lower RF band"). In the same non-limiting example, the multi-band monopole planar antenna 50 is configured not to support a RF spectrum between 894 MHz and 1700 MHz (hereinafter referred to as the "throw-away RF band"). Because the RF spectrum bandwidth of the multi-band monopole planar antenna 50 is proportionally related to the surface area of the semi-elliptical shaped conductive disc 52, elimination of the throw-away RF band means that physical dimension (e.g., height and/or width) of the multi-band monopole planar antenna 50 may be reduced. As a result, it is possible to fit the multi-band monopole planar antenna 50 into an enclosure with a reduced height. Further, by adjusting respective surface areas (e.g., increasing or decreasing height) of the first conductive disc section 54 and the second conductive disc section 56, it is possible to support other RF band combinations in the multi-band monopole planar antenna 50.

With continuing reference to FIG. 3, a pair of conductive delay lines 60(1) and 60(2) is disposed in the slot 58 between the first conductive disc section 54 and the second conductive disc section 56. The conductive delay line 60(1) has a first end feed point 62(1) conductively coupled to the first conductive disc section 54. The conductive delay line 60(1) has a second end feed point 64(1) conductively coupled to the second conductive disc section 56. The conductive delay line 60(2) has a first end feed point 62(2) conductively coupled to the first conductive disc section 54. The conductive delay line 60(2) has a second end feed point 64(2) conductively coupled to the second conductive disc section 56. According to the exemplary illustration in FIG. 3, each of the conductive delay lines 60(1) and 60(2) is horizontally disposed in the slot 58 to help reduce vertical dimension (e.g., height) of the multi-band monopole planar antenna 50. The conductive delay lines 60(1), 60(2) may be disposed in the slot 58 in any layout. In a non-limiting example, the conductive delay lines 60(1), 60(2) may be disposed between the respective first end feed points 62(1), 62(2) and the respective second end feed points 64(1), 64(2) in a U-shaped layout or a zigzag-shaped layout. In another non-limiting example, the conductive delay lines 60(1), 60(2) may be disposed vertically between the respective first end feed points 62(1), 62(2) and the respective second end feed points 64(1), 64(2). In another non-limiting example, it is possible to dispose any number of conductive delay lines between the first conductive disc section 54 and the second conductive disc section 56. Each of the conductive delay lines 60(1), 60(2) has a respective length measured between the respective first end feed points 62(1), 62(2) and the respective second end feed points 64(1), 64(2). The respective length of the each of the conductive delay lines 60(1), 60(2) may be adjusted to control a lower RF boundary of the lower RF band. For example, increasing or decreasing the respective length of each of the conductive delay lines 60(1), 60(2) may cause the lower RF boundary of the lower RF band to increase or decrease accordingly.

With continuing reference to FIG. 3, a disc feed point 66 extends outward from the first conductive disc section 54. The disc feed point 66 is configured to receive an electrical current 68 from an electrical current source (not shown) to energize the first conductive disc section 54 and the second conductive disc section 56, thus allowing electromagnetic energy to be radiated from the first conductive disc section 54 and the second conductive disc section 56, respectively. As illustrated in FIG. 3, the electrical current 68 received at the disc feed point 66 flows upward along the edges of the first conductive disc section 54, through the conductive delay lines 60(1), 60(2), and then horizontally along the edges of the second conductive disc section 56. As the electrical current 68 propagates through the first conductive disc section 54, a vertical total electric field (not shown), which is similar to the total electric field 40 in FIG. 2, is generated around the first conductive disc section 54. As a result, the first conductive disc section 54 radiates electromagnetic energy from corner points 70(1), 70(2) in the higher RF band with a vertical radiation polarization (first radiation polarization). While some of the electrical current 68 is converted into electromagnetic energy and radiated out by the first conductive disc section 54, a portion of the electrical current 68 continues flowing through the conductive delay lines 60(1), 60(2) to reach the second conductive disc section 56. At the second conductive disc section 56, the electrical current 68 flows horizontally along the edges of the second conductive disc section 56 and eventually turns into electromagnetic energy to be radiated out at end points 72(1), 72(2). The horizontally flowing electrical current 68 produces a horizontal component 74. When the horizontal component 74 conjoins a vertical component 76 produced by the electrical current 68 in the first conductive disc section 54, a slant-45 total electric field 78 is created around the second conductive disc section 56. As such, the electromagnetic energy radiated out of the end points 72(1), 72(2) in the lower RF band has a slant-45 radiation polarization (second radiation polarization). As further discussed later in this specification, the slant-45 radiation polarization in the lower RF band allows the plurality of multi-band monopole planar antennas 50 to be placed in close proximity while maintaining sufficient RF isolation in the lower RF band. For the higher RF band, space separation can provide sufficient RF isolation because of the shorter wavelength of the higher RF band.

Figure 4:
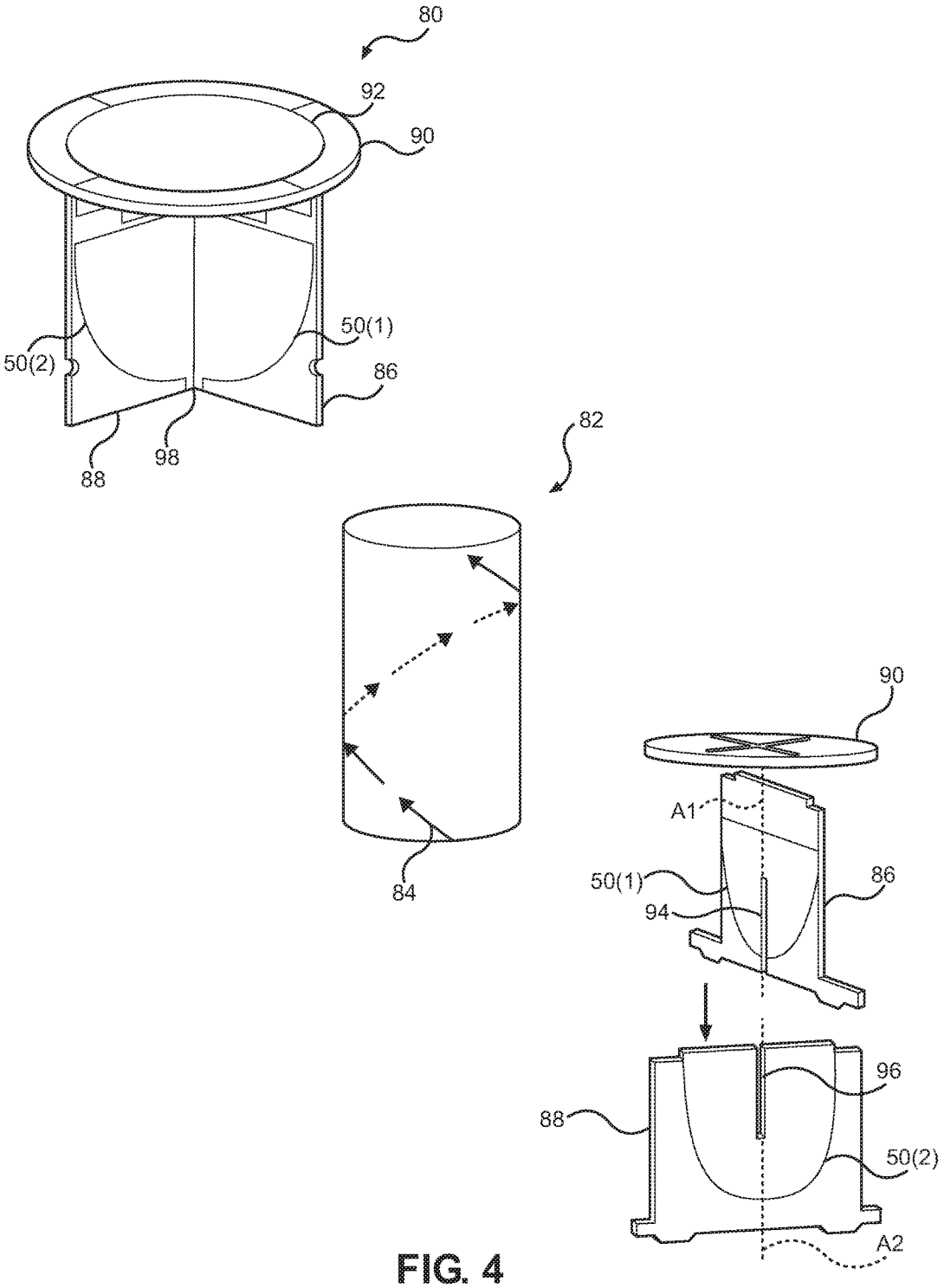
FIG. 4 is a schematic diagram illustrating an exemplary dual-band antenna element comprising two of the multi-band monopole planar antennas of FIG. 3 and configured to provide a cylinder-shaped distribution of a cylinder-shaped slant-45 total electric field around the dual-band antenna element.

Although the second conductive disc section 56 is able to radiate electromagnetic energy in the lower RF band with the slant-45 radiation polarization, the strongest slant-45 total electric fields 78 are concentrated around the end points 72(1), 72(2). To create a more even distribution of the slant-45 total electric field 78 for the multi-band monopole planar antenna 50, FIG. 4 is a schematic diagram illustrating an exemplary dual-band antenna element 80 comprising two of the multi-band monopole planar antennas 50 of FIG. 3 and configured to provide a cylinder-shaped distribution 82 of a cylinder-shaped slant-45 total electric field 84 around the dual-band antenna element 80. Elements of FIG. 3 are referenced in connection with FIG. 4 and will not be re-described herein.

With reference to FIG. 4, the dual-band antenna element 80 comprises a first substrate 86, a second substrate 88, and a circular-shaped substrate 90. A first multi-band monopole planar antenna 50(1) and a second multi-band monopole planar antenna 50(2) are mounted onto the first substrate 86 and the second substrate 88, respectively. A circular-shaped conductive disc 92 is mounted onto the circular-shaped substrate 90. In a non-limiting example, the first substrate 86, the second substrate 88, and the circular-shaped substrate 90 are circuit boards. The first substrate 86 has a first slot opening 94 disposed along a respective symmetrical center axis A1 of the first multi-band monopole planar antenna 50(1). The second substrate 88 has a second slot opening 96 disposed along a respective symmetrical center axis A2 of the second multi-band monopole planar antenna 50(2). The first substrate 86 is inserted into the second substrate 88 in such a way that the second slot opening 96 of the second substrate 88 receives the first substrate 86 within the first slot opening 94. The first substrate 86 and the second substrate 88 are substantially perpendicular to each other, thus creating a freestanding joint-structure (not shown). Accordingly, the first multi-band monopole planar antenna 50(1) in the first substrate 86 and the second multi-band monopole planar antenna 50(2) in the second substrate 88 are electrically coupled along the intersection of the first substrate 86 and the second substrate 88. The respective disc feed point 66 (not shown) of the first multi-band monopole planar antenna 50(1) and the second multi-band monopole planar antenna 50(2) are electrically coupled to provide a common feed point 98. The common feed point 98 may be coupled to an electrical feeding line (not shown) to receive the electrical current 68 (not shown).

With continuing reference to FIG. 4, the circular-shaped substrate 90 is mounted on top of the freestanding joint-structure (not shown) and electrically coupled to the first multi-band monopole planar antenna 50(1) and the second multi-band monopole planar antenna 50(2). In other words, the circular-shaped substrate 90 is placed on an opposite end from the common feed point 98. By electrically coupling the circular-shaped substrate 90 to the first multi-band monopole planar antenna 50(1) and the second multi-band monopole planar antenna 50(2), the electrical current 68 (not shown) received from the common feed point 98 will eventually flow around the circular-edge of the circular-shaped conductive disc 92. The circularly flowing electrical current 68 facilitates the cylinder-shaped distribution 82 of the cylinder-shaped slant-45 total electric field 84 around the dual-band antenna element 80.

Figure 5:
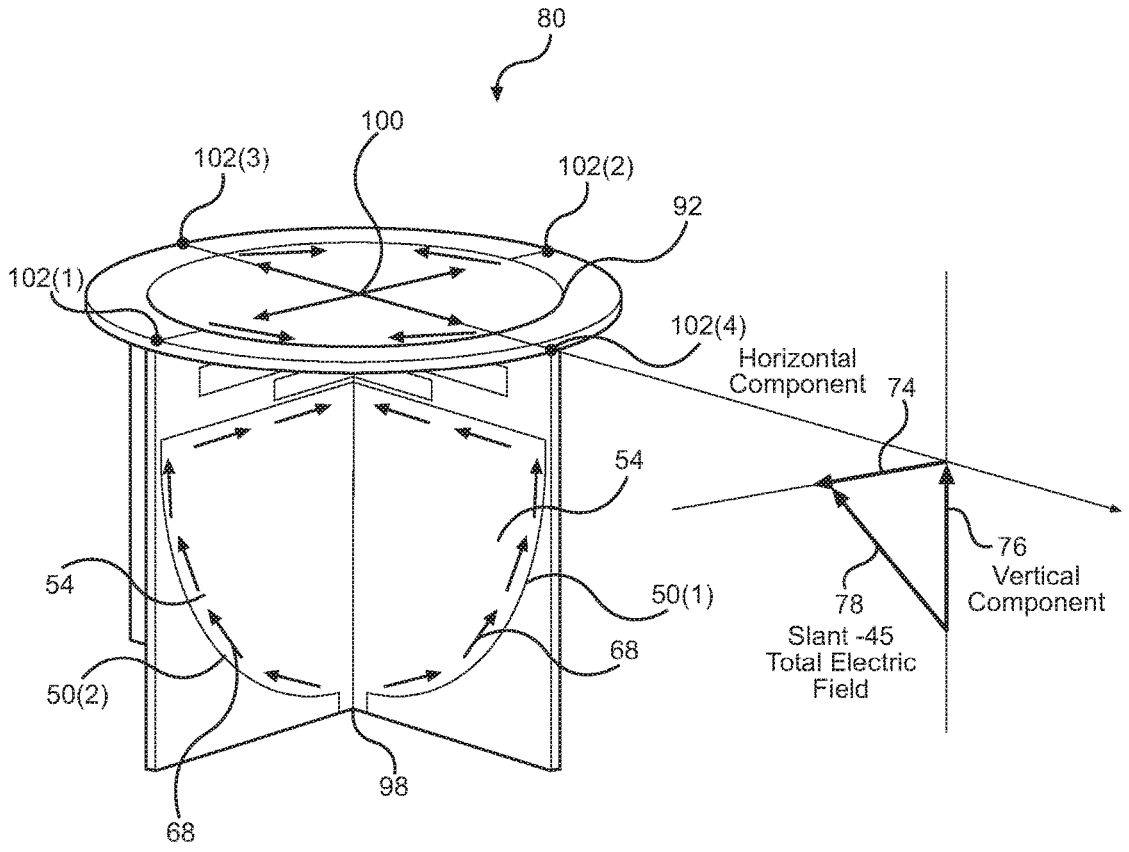
FIG. 5 is an exemplary schematic diagram of the dual-band antenna element in FIG. 4 configured to generate the cylinder-shaped approximate slant-45 total electric field of FIG. 4 when energized by an electrical current.

In this regard, FIG. 5 is an exemplary schematic diagram of the dual-band antenna element 80 in FIG. 4 configured to generate the cylinder-shaped slant-45 total electric field 84 (not shown) when energized by the electrical current 68. Common elements between FIGS. 3, 4, and 5 are shown therein with common element numbers, thus will not be re-described herein.

With reference to FIG. 5, the electrical current 68 received from a common feed point 98 flows upward along the respective edges of the first multi-band monopole planar antenna 50(1) and the second multi-band monopole planar antenna 50(2). According to discussions in reference to FIG. 3, the vertical component 76 is produced as a result of the electrical current 68 flowing through the respective first conductive disc section 54 in the first multi-band monopole planar antenna 50(1) and the second multi-band monopole planar antenna 50(2). In the circular-shaped conductive disc 92, the electrical current 68 flows from a center point 100 toward intersection points 102(1)-102(4). The intersection points 102(1), 102(2) are where the circular-shaped conductive disc 92 intersects with the respective end points 72(1), 72(2) (not shown) in the first multi-band monopole planar antenna 50(1). Likewise, the intersection points 102(3), 102(4) are where the circular-shaped conductive disc 92 intersects with the respective end points 72(1), 72(2) (not shown) in the second multi-band monopole planar antenna 50(2). As a result of the electrical current 68 flowing horizontally in the circular-shaped conductive disc 92, the horizontal component 74 is produced. Hence, the horizontal component 74 and the vertical component 76 jointly generate the slant-45 total electric field 78, which is distributed more evenly around the dual-band antenna element 80. Furthermore, the circular-shaped conductive disc 92 helps further reduce the height of the dual-band antenna element 80 so that the dual-band antenna element 80 may be provided in smaller enclosures.

Figure 6:
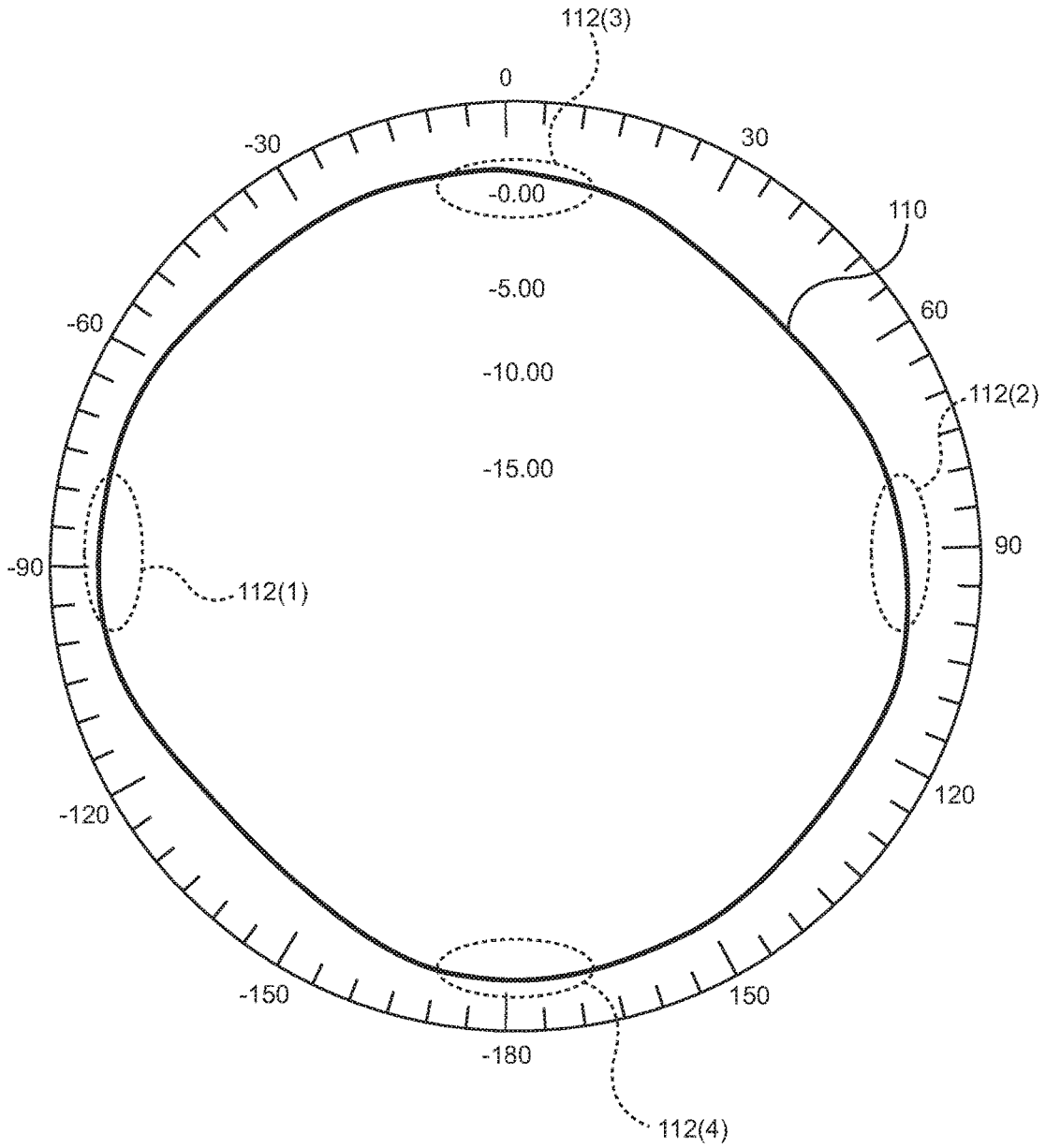
FIG. 6 is an exemplary plot of a top-view radiation pattern and good slant-45 radiation polarization regions generated by the dual-band antenna element in FIG. 5.

In this regard, FIG. 6 is an exemplary plot of a top-view radiation pattern 110 and good slant-45 radiation polarization regions 112(1)-112(4) generated by the dual-band antenna element 80 in FIG. 5. Elements in FIG. 5 are referenced in connection with FIG. 6 and will not be re-described herein. Not coincidentally, the good slant-45 radiation polarization regions 112(1)-112(4) are strongly correlated to the intersection points 102(1)-102(4) in the dual-band antenna element 80, where the horizontal component 74 and the vertical component 76 are equal (shown in FIG. 5).

Figure 7:
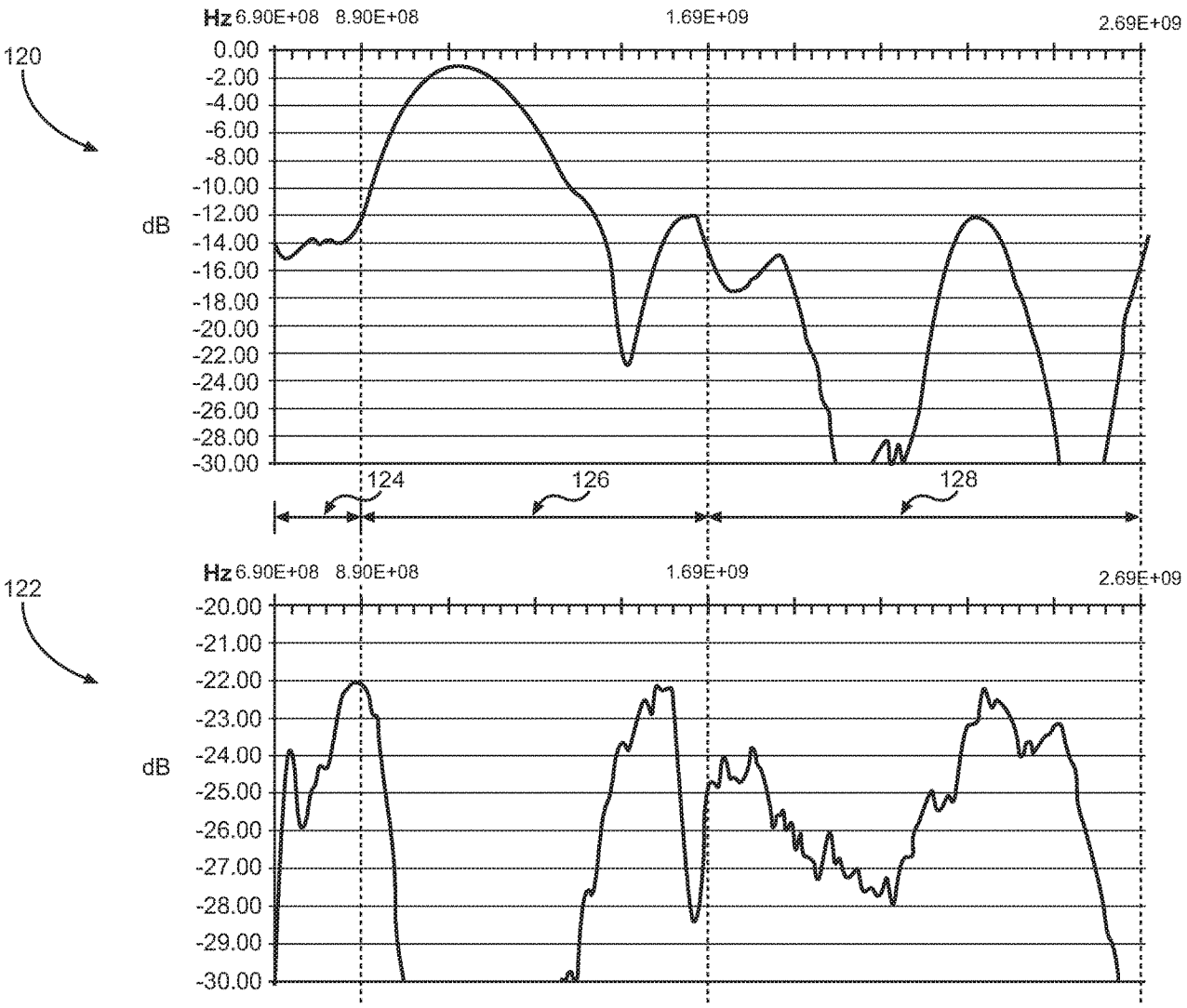
FIG. 7 is an exemplary plot of a return loss curve and an RF isolation curve that quantitatively measures the RF performance and the level of RF isolation provided by the dual-band antenna element in FIG. 5.

According to the non-limiting example discussed in reference to FIG. 3, the multi-band monopole planar antenna 50 is configured to support the higher RF band ranging from 1700 MHz to 2700 MHz and the lower RF band ranging from 698 MHz to 894 MHz. To provide a quantitative illustration of RF performance of the dual-band antenna element 80 in FIG. 5, FIG. 7 is provided. FIG. 7 is an exemplary plot of a return loss curve 120 and a RF isolation curve 122 that quantitatively measure the RF performance and the level of RF isolation provided by the dual-band antenna element 80 in FIG. 5.

As previously discussed in FIG. 5, when the electrical current 68 received from the common feed point 98 propagates through the dual-band antenna element 80, electromagnetic energy is radiated from the dual-band antenna element 80 in the higher RF band and the lower RF band. It is thus desirable to see a substantial amount of the electrical current 68 being turned into electromagnetic energy and radiated out of the dual-band antenna element 80. By measuring the amount of the electrical current 68 that flows back to the common feed point 98, the return loss curve 120 in FIG. 7 provides a quantitative insight into the RF performance of the dual-band antenna element 80. The return loss curve 120 may be divided into three band segments 124, 126, and 128 to help analyze the RF performance of the dual-band antenna element 80 in the lower RF band (698 MHz-894 MHz), the thrown-away RF band (894 MHz-1700 MHz), and the higher RF band (1700 MHz-2700 MHz), respectively.

With continuing reference to FIG. 7, the highest return losses in the band segments 124, 126, and 128 are approximately −14 decibel (dB), −1 dB, and −12 dB, respectively. In the band segment 126, the −1 dB return loss indicates that nearly all of the electrical current 68 flows back to the common feed point 98 as opposed to being radiated out as the electromagnetic energy in the thrown-away RF band. In contrast, the −14 dB return loss in the band segment 124 and the −12 dB return loss in the band segment 128 indicate that a portion of the electrical current 68 is turned into electromagnetic energy and radiated out from the dual-band antenna element 80 in the lower RF band and the higher RF band, respectively. The return loss curve 120 proves that the dual-band antenna element 80 produces electromagnetic energy radiation in the lower RF band and the higher RF band while having little electromagnetic energy radiation in the thrown-away RF band.

With continuing reference to FIG. 7, the RF isolation curve 122 provides quantitative measurements on the level of RF isolations provided by the dual-band antenna element 80. Clearly from the RF isolation curve 122, the dual-band antenna element 80 is able to provide at least −22 dB RF isolation in both the lower RF band and the higher RF band, thus allowing a plurality of the dual-band antenna elements 80 to be placed in close proximity.

Figure 8:
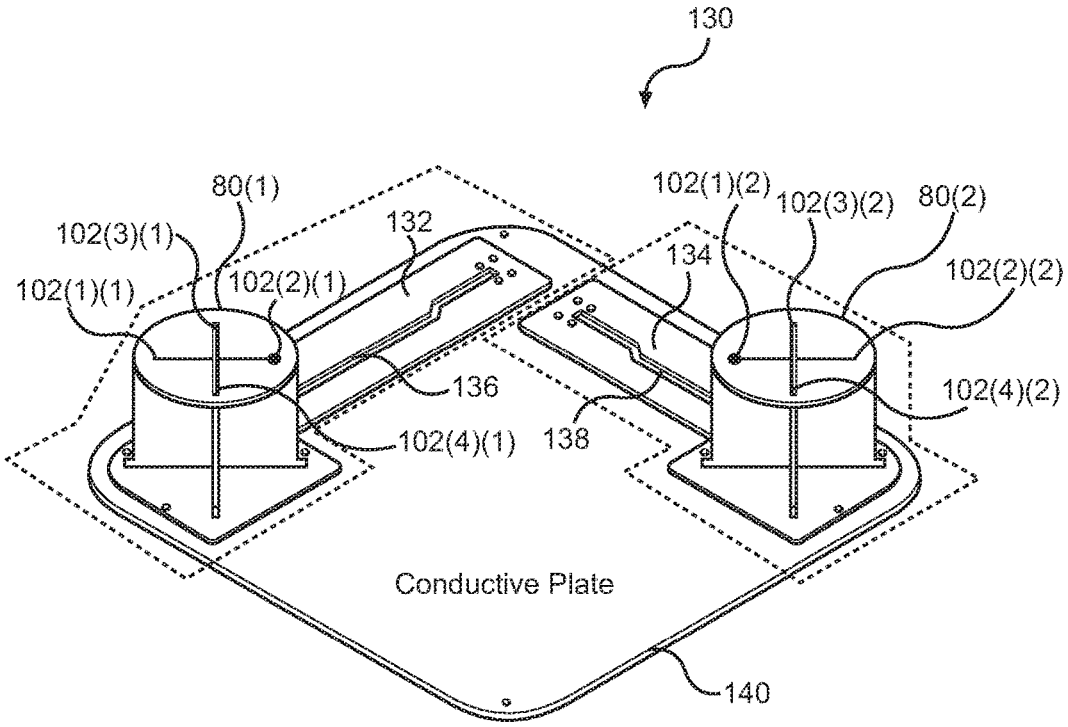
FIG. 8 is a schematic diagram of an exemplary arrangement of a MIMO antenna comprising a plurality of the dual-band antenna elements in FIG. 5.

FIG. 8 is a schematic diagram of an exemplary arrangement of a MIMO antenna 130 comprising the plurality of the dual-band antenna elements 80 in FIG. 5. Elements in FIGS. 5 and 6 are referenced in connection with FIG. 8 and will not be re-described herein.

With reference to FIG. 8, the MIMO antenna 130 comprises a first circuit board 132 and a second circuit board 134. The first circuit board 132 comprises a first dual-band antenna element 80(1) electrically coupled to a first electrical feeding line 136 via a first common feed point (not shown). The second circuit board 134 comprises a second dual-band antenna element 80(2) electrically coupled to a second electrical feeding line 138 via a second common feed point (not shown). The first circuit board 132 and the second circuit board 134 are mounted on a planar mounting surface 140. In a non-limiting example, the planar mounting surface 140 is a conductive plate. Like the dual-band antenna element 80 in FIG. 5, the first dual-band antenna element 80(1) has intersection points 102(1)(1), 102(2)(1), 102(3)(1), and 102(4)(1) that produce the good slant-45 radiation polarization regions 112(1)-112(4) (not shown), respectively. Likewise, the second dual-band antenna element 80(2) has intersection points 102(1)(2), 102(2)(2), 102(3)(2), and 102(4)(2) that produce the good slant-45 radiation polarization regions 112(1)-112(4) (not shown), respectively. In a non-limiting example, the first dual-band antenna element 80(1) and the second dual-band antenna element 80(2) are arranged in such a way that one pair of the intersection points 102(1)(1), 102(2)(1) or 102(3)(1), 102(4)(1) in the first dual-band antenna element 80(1) is aligned against another pair of the intersection points 102(1)(2), 102(2)(2) or 102(3)(2), 102(4)(2) in the second dual-band antenna element 80(2). Such alignment allows one of the good slant-45 radiation polarization regions 112(1)-112(4) produced by the first dual-band antenna element 80(1) to be in a linear alignment with one of the good slant-45 radiation polarization regions 112(1)-112(4) produced by the second dual-band antenna element 80(2). As a result of such arrangement, the RF isolation between the first dual-band antenna element 80(1) and the second dual-band antenna element 80(2) is maximized.

Figure 9:
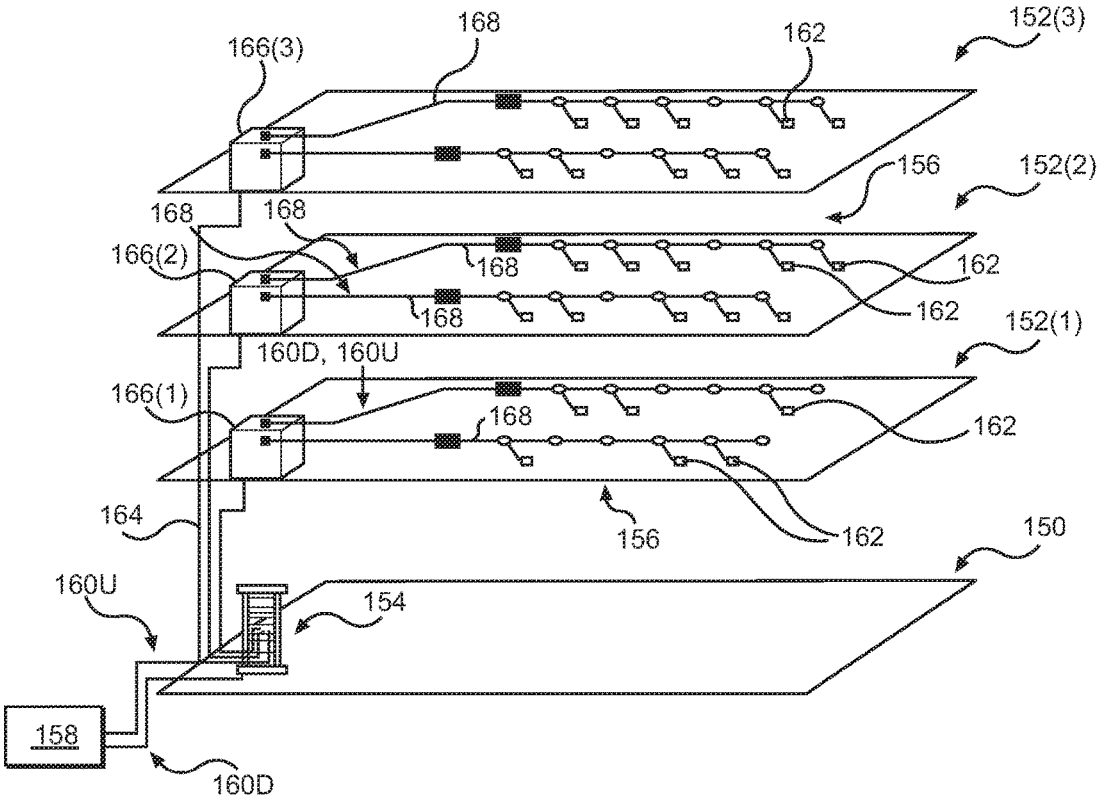
FIG. 9 is a partially schematic cut-away diagram of an exemplary building infrastructure in which the MIMO antenna of FIG. 8 is employed in one or more remote antenna units in a DAS that can be configured with the multi-band monopole planar antennas according to any of the embodiments described herein to provide MIMO-based wireless communications services.

The MIMO antenna 130 of FIG. 8 may be provided in an indoor environment, as illustrated in FIG. 9. FIG. 9 is a partially schematic cut-away diagram of an exemplary building infrastructure in which the MIMO antenna 130 of FIG. 8 is employed in one or more remote antenna units in a DAS that can be configured with the multi-band monopole planar antennas 50 in FIG. 3 according to any of the embodiments described to provide MIMO-based wireless communications services. The building infrastructure 150 in this embodiment includes a first (ground) floor 152(1), a second floor 152(2), and a third floor 152(3). The floors 152(1)-152(3) are serviced by a central unit 154 to provide antenna coverage areas 156 in the building infrastructure 150. The central unit 154 is communicatively coupled to the base station 158 to receive downlink communications signals 160D from the base station 158. The central unit 154 is communicatively coupled to remote antenna units 162 to receive uplink communications signals 160U from the remote antenna units 162. The remote antenna units 162 may employ the MIMO antenna 130 to enable MIMO-based wireless communications services. The downlink and uplink communications signals 160D, 160U communicated between the central unit 154 and the remote antenna units 162 are carried over a riser cable 164. The riser cable 164 may be routed through interconnect units (ICUs) 166(1)-166(3) dedicated to each of the floors 152(1)-152(3) that route the downlink and uplink communications signals 160D, 160U to the remote antenna units 162 and also provide power to the remote antenna units 162 via array cables 168.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A dual-band monopole planar antenna, comprising:

a semi-elliptical shaped conductive disc having a symmetrical center axis;

a slot disposed in the semi-elliptical shaped conductive disc along a longitudinal axis substantially perpendicular to the symmetrical center axis to separate the semi-elliptical shaped conductive disc into a first conductive disc section and a second conductive disc section;

a conductive delay line having a first end feed point and a second end feed point disposed in the slot, wherein the first end feed point is conductively coupled to the first conductive disc section and the second end feed point is conductively coupled to the second conductive disc section; and a disc feed point disposed in the first conductive disc section, wherein the disc feed point is configured to receive an electrical current from an electrical current source;

wherein the conductive delay line is configured to receive the electrical current from the first conductive disc section at the first end feed point and provide the electrical current to the second conductive disc section at the second end feed point;

wherein the first conductive disc section is configured to radiate electromagnetic energy on a first radio frequency (RF) band with a first radiation polarization in response to receiving the electrical current from the disc feed point; and wherein the second conductive disc section is configured to radiate electromagnetic energy on a second RF band having lower frequency than the first RF band with a second radiation polarization different from the first radiation polarization in response to receiving the electrical current from the second end feed point of the conductive delay line.

2. The dual-band monopole planar antenna of claim 1, wherein a respective surface area of the first conductive disc section determines an impedance bandwidth for the first RF band.

3. The dual-band monopole planar antenna of claim 2, wherein a respective surface area of the second conductive disc section determines a respective impedance bandwidth for the second RF band.

4. The dual-band monopole planar antenna of claim 3, wherein a respective length of the conductive delay line is measured between the first end feed point and the second end feed point, wherein the respective length of the conductive delay line determines a lower RF boundary of the second RF band.

5. The dual-band monopole planar antenna of claim 4, wherein the conductive delay line is disposed horizontally along the longitudinal axis.

6. The dual-band monopole planar antenna of claim 4, wherein the first radiation polarization is a vertical radiation polarization.

7. The dual-band monopole planar antenna of claim 4, wherein the second radiation polarization is an approximate slant 45° (slant-45) radiation polarization.

8. The dual-band monopole planar antenna of claim 4, wherein:

the first RF band is between approximately 1700 megahertz (MHz) and 2700 MHz; and the second RF band is between approximately 698 MHz and 894 MHz.

9. A dual-band antenna element, comprising:

a first dual-band monopole planar antenna mounted on a first substrate; and a second dual-band monopole planar antenna mounted on a second substrate;

wherein the first dual-band monopole planar antenna and the second dual-band monopole planar antenna each comprises:

a respective semi-elliptical shaped conductive disc having a respective symmetrical center axis;

a respective slot disposed in the respective semi-elliptical shaped conductive disc along a respective longitudinal axis substantially perpendicular to the respective symmetrical center axis to separate the respective semi-elliptical shaped conductive disc into a respective first conductive disc section and a respective second conductive disc section;

a respective conductive delay line having a respective first end feed point and a respective second end feed point disposed in the respective slot, wherein the respective first end feed point is conductively coupled to the respective first conductive disc section and the respective second end feed point is conductively coupled to the respective second conductive disc section; and a respective disc feed point disposed in the respective first conductive disc section, wherein the respective disc feed point is configured to receive an electrical current from an electrical current source;

wherein the first substrate comprises a first slot opening disposed along the respective symmetrical center axis of the first dual-band monopole planar antenna;

wherein the second substrate comprises a second slot opening disposed along the respective symmetrical center axis of the second dual-band monopole planar antenna;

wherein the second slot opening of the second substrate receives the first substrate within the first slot opening to dispose the second dual-band monopole planar antenna substantially perpendicular to the first dual-band monopole planar antenna;

wherein the first dual-band monopole planar antenna and the second dual-band monopole planar antenna are electrically coupled along an intersection of the first substrate and the second substrate;

wherein the respective disc feed point of the first dual-band monopole planar antenna and the respective disc feed point of the second dual-band monopole planar antenna are electrically coupled to provide a common feed point for the dual-band antenna element; and wherein the first dual-band monopole planar antenna and the second dual-band monopole planar antenna are configured to each generate a cylinder-shaped slant 45° (slant-45) total electric field when the electrical current is received at the common feed point.

10. The dual-band antenna element of claim 9, wherein the first substrate and the second substrate are each comprised of circuit boards.

11. The dual-band antenna element of claim 10, further comprising an electrical feeding line coupled to the common feed point.

12. The dual-band antenna element of claim 11, further comprising a circular-shaped conductive disc electrically coupled to the first dual-band monopole planar antenna and the second dual-band monopole planar antenna on an opposite end from the common feed point, wherein the circular-shaped conductive disc is substantially perpendicular to the respective symmetrical center axis of the first dual-band monopole planar antenna and the second dual-band monopole planar antenna.

13. The dual-band antenna element of claim 9, wherein:

the respective conductive delay line in the first dual-band monopole planar antenna and the second dual-band monopole planar antenna is configured to receive the electrical current from the respective first conductive disc section at the respective first end feed point and provide the electrical current to the respective second conductive disc section at the respective second end feed point;

the respective first conductive disc section in the first dual-band monopole planar antenna and the second dual-band monopole planar antenna is configured to radiate electromagnetic energy on a first radio frequency (RF) band with a vertical radiation polarization in response to receiving the electrical current from the respective disc feed point; and the respective second conductive disc section in the first dual-band monopole planar antenna and the second dual-band monopole planar antenna is configured to radiate electromagnetic energy on a second RF band lower than the first RF band with a slant-45 radiation polarization in response to receiving the electrical current from the respective second end feed point of the respective conductive delay line.

14. A multiple-input multiple-output (MIMO) antenna, comprising:

a planar mounting surface;

a first dual-band antenna element disposed on the planar mounting surface, wherein the first dual-band antenna element comprises at least one first dual-band monopole planar antenna having a first symmetrical center axis substantially perpendicular to the planar mounting surface and a first longitudinal axis substantially perpendicular to the first symmetrical center axis; and a second dual-band antenna element disposed on the planar mounting surface, wherein the second dual-band antenna element comprises at least one second dual-band monopole planar antenna having a second symmetrical center axis substantially perpendicular to the planar mounting surface and a second longitudinal axis substantially perpendicular to the second symmetrical center axis;

wherein the second dual-band antenna element is disposed on the planar mounting surface such that the second longitudinal axis is substantially aligned with the first longitudinal axis in the first dual-band antenna element.

15. The MIMO antenna of claim 14, wherein the planar mounting surface is a conductive substrate.

16. The MIMO antenna of claim 15, wherein the at least one first dual-band monopole planar antenna and the at least one second dual-band monopole planar antenna each further comprise:

a respective semi-elliptical shaped conductive disc having a respective symmetrical center axis;

a respective slot disposed in the respective semi-elliptical shaped conductive disc along a respective longitudinal axis substantially perpendicular to the respective symmetrical center axis to separate the respective semi-elliptical shaped conductive disc into a respective first conductive disc section and a respective second conductive disc section;

a respective conductive delay line having a respective first end feed point and a respective second end feed point disposed in the respective slot, wherein the respective first end feed point is conductively coupled to the respective first conductive disc section and the respective second end feed point is conductively coupled to the respective second conductive disc section; and a respective disc feed point disposed in the respective first conductive disc section, wherein the respective disc feed point is configured to receive an electrical current from an electrical current source.

17. The MIMO antenna according of claim 16, wherein:

the respective conductive delay line in the at least one first dual-band monopole planar antenna and the at least one second dual-band monopole planar antenna is configured to receive the electrical current from the respective first conductive disc section at the respective first end feed point and provide electrical current to the respective second conductive disc section at the respective second end feed point;

the respective first conductive disc section in the at least one first dual-band monopole planar antenna and the at least one second dual-band monopole planar antenna is configured to radiate electromagnetic energy on a first radio frequency (RF) band with a vertical radiation polarization in response to receiving the electrical current from the respective disc feed point; and the respective second conductive disc section in the at least one first dual-band monopole planar antenna and the at least one second dual-band monopole planar antenna is configured to radiate electromagnetic energy on a second RF band lower than the first RF band with a slant-45 radiation polarization in response to receiving the electrical current from the respective second end feed point of the respective conductive delay line.

18. The MIMO antenna of claim 14, wherein:

the first dual-band antenna element is mounted on a first circuit board; and the second dual-band antenna element is mounted on a second circuit board electrically decoupled from the first circuit board.

19. The MIMO antenna of claim 18, wherein:

the first circuit board comprises a first electrical feeding line coupled to a first common feed point exposed by the first dual-band antenna element; and the second circuit board comprises a second electrical feeding line coupled to a second common feed point exposed by the second dual-band antenna element.

20. The MIMO antenna of claim 18, wherein the first dual-band antenna element and the second dual-band antenna element are electrically decoupled from each other.

* * * * *